US009487987B2

(12) United States Patent
Baczweski et al.

(10) Patent No.: US 9,487,987 B2
(45) Date of Patent: Nov. 8, 2016

(54) METHOD AND APPARATUS FOR A DOOR

(71) Applicants: Gary Baczweski, Garden Ridge, TX (US); Ken Gordon, Cibolo, TX (US)

(72) Inventors: Gary Baczweski, Garden Ridge, TX (US); Ken Gordon, Cibolo, TX (US)

( * ) Notice: Subject to any disclaimer, the term of this patent is extended or adjusted under 35 U.S.C. 154(b) by 0 days.

(21) Appl. No.: 14/743,799

(22) Filed: Jun. 18, 2015

(65) Prior Publication Data

US 2015/0368950 A1 Dec. 24, 2015

Related U.S. Application Data

(60) Provisional application No. 62/015,790, filed on Jun. 23, 2014.

(51) Int. Cl.

| | |
|---|---|
| ***E05D 15/38*** | (2006.01) |
| ***E05D 13/00*** | (2006.01) |
| ***E05D 15/44*** | (2006.01) |
| ***E05F 15/686*** | (2015.01) |

(52) U.S. Cl.

CPC ..... *E05D 15/445* (2013.01); *E05D 13/006* (2013.01); *E05F 15/686* (2015.01); *E05Y 2900/106* (2013.01); *E05Y 2900/108* (2013.01)

(58) Field of Classification Search

CPC .. E05D 15/445; E05D 13/006; E05F 15/686; E05Y 2900/106; E05Y 2900/108

USPC ..... 49/197, 199, 322

See application file for complete search history.

(56) References Cited

U.S. PATENT DOCUMENTS

| | | | | | |
|---|---|---|---|---|---|
| 2,150,321 | A * | 3/1939 | Ferris | E05D 15/445 | 49/205 |
| 2,185,828 | A * | 1/1940 | Blodgett | E05D 13/006 | 16/DIG. 20 |
| 2,943,886 | A * | 7/1960 | Wilkinson | B60P 1/56 | 105/240 |
| 3,185,528 | A * | 5/1965 | Peterson | B60P 1/56 | 105/240 |
| 3,188,698 | A * | 6/1965 | Zoll | E05D 13/006 | 29/530 |
| 3,849,937 | A * | 11/1974 | Blumenthal | E05D 15/445 | 49/205 |
| 4,102,382 | A * | 7/1978 | Vesbach | E05F 15/59 | 160/188 |
| 4,368,770 | A * | 1/1983 | Ulfhielm | E05D 13/006 | 160/84.02 |
| 4,443,972 | A * | 4/1984 | Dolhaine | E05D 15/405 | 49/197 |
| 4,696,375 | A * | 9/1987 | Matthews | B66B 13/06 | 187/313 |

(Continued)

*Primary Examiner* — Justin Rephann

(74) *Attorney, Agent, or Firm* — Christopher L. Makay

(57) ABSTRACT

A door system designed for buildings that store large objects such as airplanes or farm, marine, and other heavy equipment. The door system is comprised of a door, a lift frame, and a brake system disposed within the lift frame and coupled with the door. Furthermore, an articulating arm system connects to the lift frame and the door and a drive system connects to the brake system. The drive system moves the brake system within the lift frame such that the brake system and the articulating arm system guide the door between an open and a closed position.

14 Claims, 24 Drawing Sheets

(56) References Cited

U.S. PATENT DOCUMENTS 4,725,185 A * 2/1988 Neagu ..... B60P 1/4478 187/369
4,891,908 A * 1/1990 Aquilina ..... E05F 15/59 49/199
5,291,686 A * 3/1994 Sears ..... E05D 13/006 49/13
5,373,663 A * 12/1994 Turini ..... E05D 13/145 49/200
6,189,266 B1 * 2/2001 Mihalcheon ..... E05D 13/006 160/201
6,434,886 B1 * 8/2002 Johnson ..... E05D 15/165 160/205
6,862,845 B2 * 3/2005 Schiks ..... E05D 13/1269 49/200
7,219,711 B2 * 5/2007 Keller ..... E05D 15/264 160/188
7,484,332 B2 * 2/2009 Hormann ..... E05D 13/006 160/201
8,025,090 B2 * 9/2011 Kicher ..... E05D 13/12 160/191
9,243,435 B1 * 1/2016 Kaounas ..... E05D 13/006
9,273,507 B2 * 3/2016 Petrat ..... E05F 15/53
2002/0029524 A1 * 3/2002 Kerkvliet ..... E05D 11/00 49/200
2003/0041520 A1 * 3/2003 Mullet ..... E05D 13/006 49/322
2003/0051408 A1 * 3/2003 Mullet ..... E05D 13/006 49/200
2003/0051409 A1 * 3/2003 Bruns ..... E05D 13/006 49/322
2005/0224193 A1 * 10/2005 Nelzi ..... E05D 13/006 160/188
2007/0204515 A1 * 9/2007 Barriault ..... E05D 13/003 49/322
2008/0023603 A1 * 1/2008 Michaud ..... E05D 13/006 248/222.51
2008/0086947 A1 * 4/2008 Crown ..... E05F 15/51 49/199
2010/0319258 A1 12/2010 Betker
2012/0186158 A1 * 7/2012 Sanke ..... E05D 13/006 49/322
2012/0279131 A1 * 11/2012 Haba ..... E05D 13/006 49/322
2015/0322703 A1 * 11/2015 Matsuo ..... E05B 65/0021 160/191

* cited by examiner

METHOD AND APPARATUS FOR A DOOR

CROSS-REFERENCE TO RELATED APPLICATION

This present application claims all available benefit, under 35 U.S.C. §119(e), of U.S. provisional patent application Ser. No. 62/015,790 filed Jun. 23, 2014. By this reference, the full disclosure of U.S. provisional patent application Ser. No. 62/015,790 is incorporated herein as though now set forth in its entirety.

BACKGROUND OF THE INVENTION

1. Field of the Invention

The present invention relates generally to buildings that store large objects such as airplanes and farm, marine, and other heavy equipment, and, more particularly, but not by way of limitation to doors for such buildings.

2. Description of the Related Art

Buildings that store large objects such as airplanes and farm, marine, and other heavy equipment require large doors that enable the convenient ingress and egress of the airplanes and equipment. The large size of doors required for such buildings pose many design challenges. The doors must operate quickly and efficiently, they must be large, but also structurally sound in that they do not display sagging or bowing in either the open or closed positions. In addition, due to their large nature, the doors must also be designed to resist wind in both the open and closed positions. A particular design used in large storage buildings is a one-piece tilt-up door.

One-piece tilt-up door designs solve many of the problems that doors of large storage facilities encounter. However, in the industry several challenges are still faced by tilt-up door designs. Because the door itself must be large, the drive system to open and close the tilt-up door tends to be complicated. The drive system of tilt-up doors used in large storage applications tend to have multiple drivers that have to be synched in order to open or close the door. Having multiple drivers add complexity and cost to the construction and operation of a tilt-up door design. In addition, the guide system used to tilt the door in a tilt-up door design is often complicated requiring precise manufacturing and precluding fabrication on site. Finally, due to their large nature, the door in a tilt-up door design requires a safety mechanism to prevent unwanted closing of the door.

Accordingly, a large one-piece tilt-up door that is easy to assemble, allows fabrication on site, is efficient and simple in design, and prevents the unwanted closing of the door would be beneficial.

SUMMARY OF THE INVENTION

In accordance with a method and apparatus for a door, a door system designed for buildings that store large objects such as airplanes or farm, marine, and other heavy equipment. The door system is comprised of a door including a guide arm bracket secured to the door, a lift frame including first and second guide columns with a header therebetween, a lock system secured to the door and the lift frame, and a brake system disposed within the lift frame and coupled with the door. Furthermore, an articulating arm system connects to the lift frame and the door and a drive system connects to the brake system. The drive system moves the brake system within the lift frame such that the brake system and the articulating arm system guide the door between an open and a closed position. The door further includes a support truss that prevents bending and bowing in the door when the door moves between its closed and open positions.

The brake system comprises a first brake assembly disposed in the first guide column and connected to the door via a lift pin. The first brake assembly is movable between an unlocked position whereby the first brake assembly moves relative to the first guide column and a locked position whereby the first brake assembly engages the first guide column to stop movement of the first brake assembly relative to the first guide column.

The first brake assembly comprises a lifting block, a linear bearing assembly, and a safety brake. The lifting block includes a lift pin receiving slot that receives the lift pin therethrough to engage the linear bearing assembly. The lift pin receiving slot of the lifting block includes a first end and a second end that is elongated to allow for movement of the lifting block relative to the lift pin and the linear bearing assembly. The lifting block couples with the drive system, wherein the coupling of the lifting block with the drive system moves the lifting block relative to the lift pin such that the lift pin engages the first end of the lift pin receiving slot. When the lift pin engages the first end of the lift pin receiving slot the first brake assembly resides in its unlocked position.

The safety brake connects between the lifting block and the linear bearing assembly and moves between a retracted position and an extended position. The retracted position disengages the safety brake from the first guide column to allow the first brake assembly to move relative to the first guide column. The extended position engages the safety brake with the first guide column to stop movement of the first brake assembly relative to the first guide column. Furthermore, the coupling of the lifting block with the drive system moves the lifting block relative to the linear bearing assembly such that the safety brake moves to its retracted position.

The biasing member connects to the lifting block and the linear bearing assembly and is movable between a first position and a second position. The coupling of the lifting block with the drive system moves the lifting block relative to the linear bearing assembly such that the biasing member moves to its first position. In addition, upon a decoupling of the lifting block from the drive system, the biasing member moves from its first position to its second position. When the biasing member moves to its second position, the lifting block moves relative to the linear bearing assembly and the lift pin such that the lift pin engages the second end of the lift pin receiving slot. In addition, the safety brake moves to its extended position whereby the first brake assembly resides in its locked position thereby preventing movement of the first brake assembly relative to the first guide column.

The brake system further comprises a second brake assembly disposed in the second guide column and connected to the door via a lift pin. The second brake assembly is movable between an unlocked position whereby the second brake assembly moves relative to the second guide column and a locked position whereby the second brake assembly engages the second guide column to stop movement of the second brake assembly relative to the second guide column.

The second brake assembly comprises a lifting block, a linear bearing assembly, and a safety brake. The lifting block includes a lift pin receiving slot that receives the lift pin therethrough to engage the linear bearing assembly. The lift pin receiving slot of the lifting block includes a first end and a second end that is elongated to allow for movement of the lifting block relative to the lift pin and the linear bearing assembly. The lifting block couples with the drive system, wherein the coupling of the lifting block with the drive system moves the lifting block relative to the lift pin such that the lift pin engages the first end of the lift pin receiving slot. When the lift pin engages the first end of the lift pin receiving slot the second brake assembly resides in its unlocked position.

The safety brake connects between the lifting block and the linear bearing assembly and moves between a retracted position and an extended position. The retracted position disengages the safety brake from the second guide column to allow the second brake assembly to move relative to the second guide column. The extended position engages the safety brake with the second guide column to stop movement of the second brake assembly relative to the second guide column. Furthermore, the coupling of the lifting block with the drive system moves the lifting block relative to the linear bearing assembly such that the safety brake moves to its retracted position.

The biasing member connects to the lifting block and the linear bearing assembly of the second brake assembly and is movable between a first position and a second position. The coupling of the lifting block with the drive system moves the lifting block relative to the linear bearing assembly such that the biasing member moves to its first position. In addition, upon a decoupling of the lifting block from the drive system, the biasing member moves from its first position to its second position. When the biasing member moves to its second position, the lifting block moves relative to the linear bearing assembly and the lift pin such that the lift pin engages the second end of the lift pin receiving slot. In addition, the safety brake moves to its extended position whereby the second brake assembly resides in its locked position thereby preventing movement of the second brake assembly relative to the second guide column.

The drive system comprises a driver secured with the header wherein the driver is movable between a first position that opens the door and a second position that closes the door. In addition, the drive system comprises pulley assemblies secured with the header that direct a first cable to the first brake assembly and a second cable to the second brake assembly.

The first cable connects with the driver and runs from the driver in the first direction to engage the pulley assemblies. The first cable engages the pulley assemblies such that the pulley assemblies redirect the first cable to a second direction prior to directing the first cable to the first brake assembly. Movement of the driver to its first position results in the first cable lifting the first brake assembly thereby opening the door. Furthermore, movement of the driver to its second position results in the first cable lowering the first brake assembly thereby closing the door.

The second cable connects with the driver and runs from the driver in a first direction and engages the pulley assemblies. The second cable engages the pulley assemblies such that the pulley assemblies direct the second cable to the second brake assembly. Movement of the driver to its first position results in the second cable lifting the second brake assembly thereby opening the door. Furthermore, movement of the driver to its second position results in the second cable lowering the second brake assembly thereby closing the door.

The pulley assemblies comprise a first pulley assembly secured with the header, a second pulley assembly secured with the header at a first end, and a third pulley assembly pulley assembly secured with the header at a second end.

The first pulley assembly redirects the first cable from the first direction to the second direction and along the second direction to the second pulley assembly. The second pulley assembly then directs the first cable along the first guide column and to the first brake assembly. In addition, the first pulley assembly directs the second cable along the first direction and to the third pulley assembly. The third pulley assembly then directs the second cable along the second guide column and to the second brake assembly. After the first and second cable connect to the first and second brake assembly respectively, movement of the driver between its first position and its second position simultaneously acts upon the first cable and the second cable to lift and lower the first and second brake assembly thereby opening and closing the door.

The articulating arm system comprises a support arm securable with the lift frame, a guide arm including a first end and a second end, and a hinge pin. The guide arm secures at the first end with the support arm such that the guide arm rotates about the first end. The hinge pin secures with the second end of the guide arm and engages a slot of the guide arm bracket such that the hinge pin allows rotational and vertical movement of the door. The slot of the guide arm bracket includes a first end and a second end wherein the first end of the slot initially contacts the hinge pin when the door resides in its closed position.

The lock system comprises a latch assembly, including a lock bracket secured with the header of the lift frame and a latch secured with the door and engageable with the lock bracket. In addition, the lock system comprises at least one lock pin secured with the door at a lower portion thereof. When the door resides in the closed position, the latch engages the lock bracket and the lock pin engages a receiving cavity of a foundation supporting the lift frame to secure the door against wind forces.

Moving the door from the closed position to the open position comprises the drive system raising the brake system within the lift frame such that the lift pin moves the door vertically upward. As the door moves vertically upward, the guide arm bracket rises vertically until the second end of the slot contacts the hinge pin of the articulating arm system. In addition, the latch disengages from the lock bracket and the lock pin disengages from the receiving cavity. After the second end of the slot contacts the hinge pin, the lift pin rotates within the brake system and the slot of the guide arm bracket rotates about the hinge pin thereby rotating the door. The articulating arm system guides the rotation of the door such that the guide arm rotates away from the lift frame around its first end thereby tilting the door away from the lift frame. The door continues to tilt away from the lift frame until the drive system ceases raising the brake system within the lift frame, whereby the door resides in the open position.

Moving the door from the open position to the closed position comprises the drive system lowering the brake system within the lift frame such that the lift pin moves the door vertically downward. As the door moves vertically downward, the lift pin rotates within the brake system and the slot of the guide arm bracket rotates about the hinge pin thereby rotating the door. The articulating arm system guides the rotation of the door such that the guide arm rotates toward the lift frame around its first end thereby tilting the door to a substantially parallel position with the lift frame. After the door reaches a substantially parallel position with the lift frame, the guide arm bracket lowers vertically until the first end of the slot contacts the hinge pin of the articulating arm system. In addition, the latch engages the lock bracket and the lock pin engages the receiving cavity.

The door continues to lower vertically until the drive system ceases lowering the brake system within the lift frame, whereby the door resides in the closed position.

DETAILED DESCRIPTION OF THE PREFERRED EMBODIMENT

As required, detailed embodiments of the present invention are disclosed herein; however, it is to be understood that the disclosed embodiments are merely exemplary of the invention, which may be embodied in various forms. Figures are not necessarily to scale, and some features may be exaggerated to show details of particular components or steps.

Figure 1:
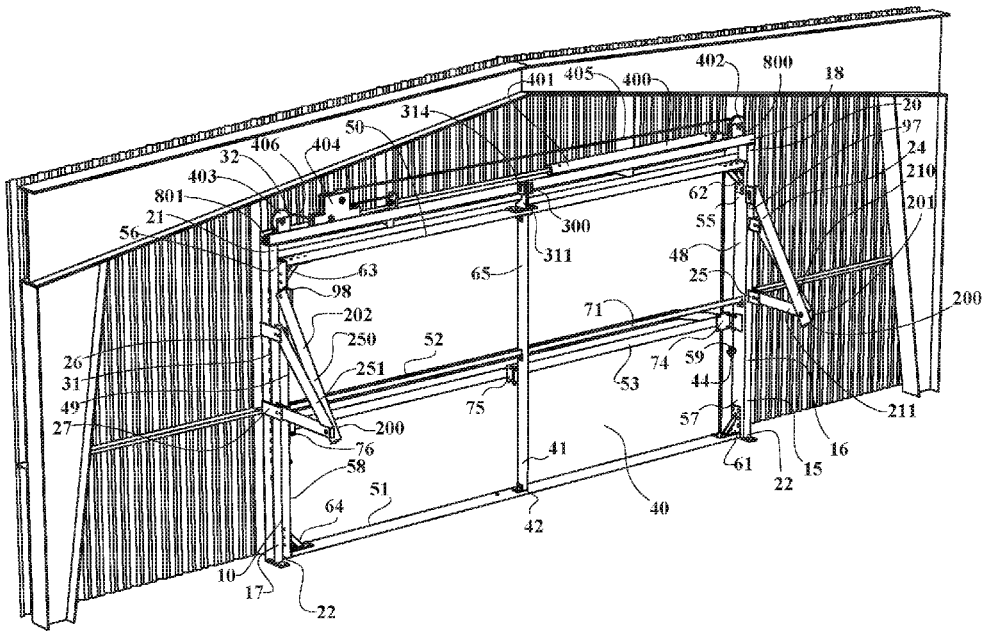
FIG. 1 is perspective rear view illustrating a door system according to the preferred embodiment.
Figure 6:
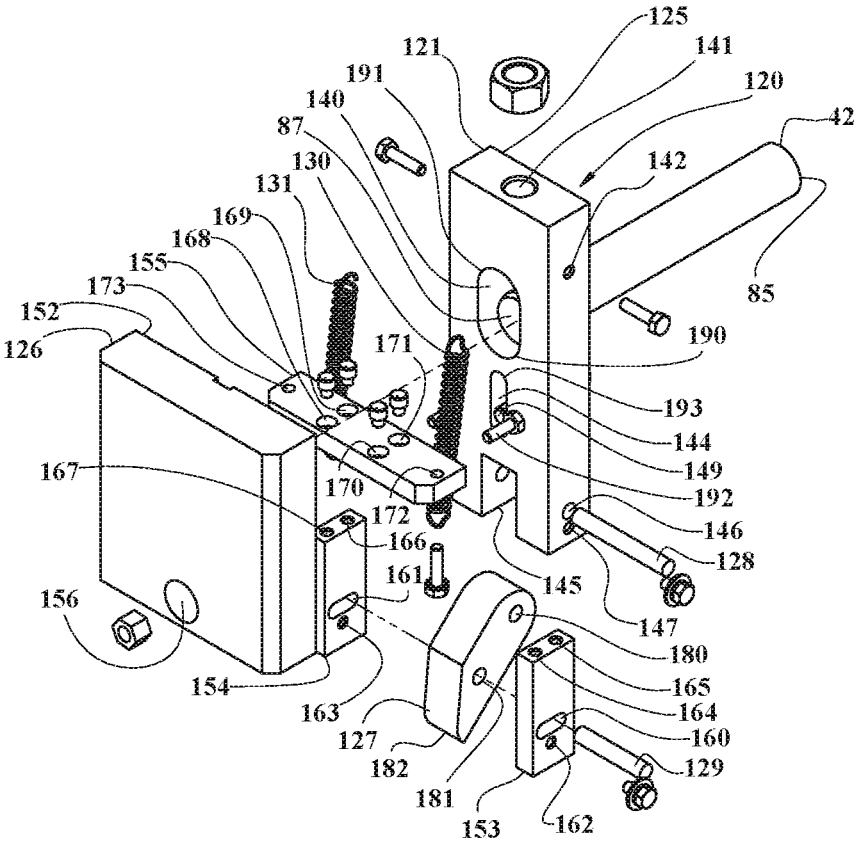
FIGS. 6 and 7 are exploded perspective views illustrating a brake assembly of a brake system for the door system.
Figure 7:
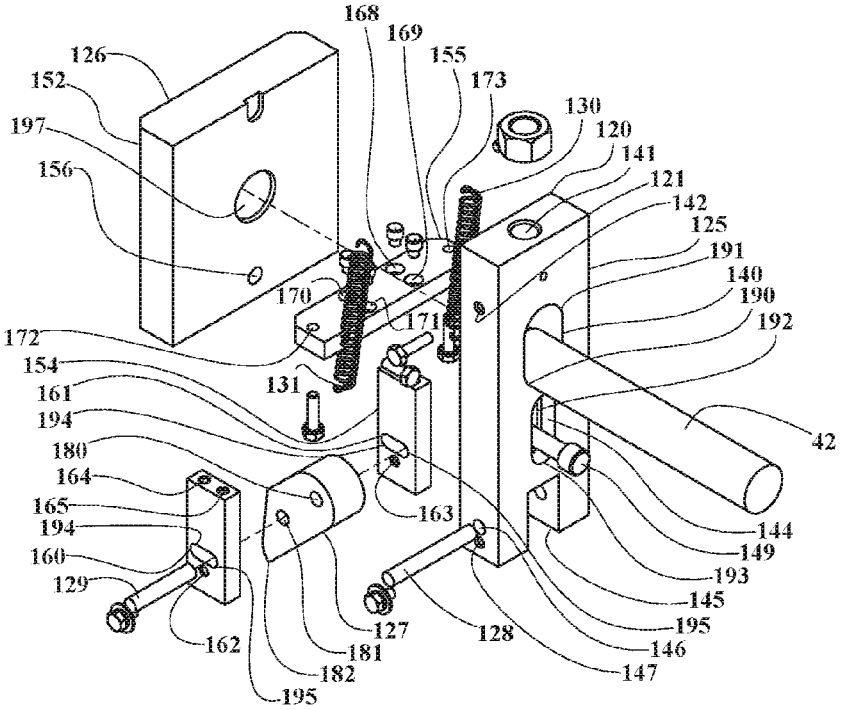
Figure 24:
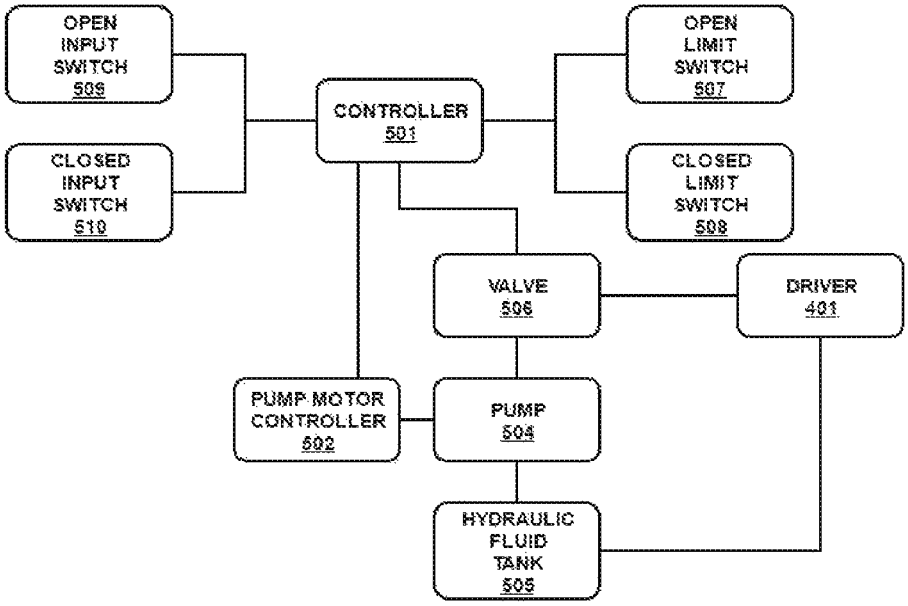
FIG. 24 is a block diagram illustrating a control system for the door system.

As illustrated in FIGS. 1, 6, and 24 a door system 10 includes a lift frame 15, a door 40, a lift pin 42, a second lift pin identical to lift pin 42 (not shown), a brake system 120 comprised of a brake assembly 121 and a second brake assembly identical to the brake assembly 121 (not shown), an articulating arm system 200, a lock system 300, a drive system 400, and a control system 500. The door system 10 is a tilt-up door system designed for buildings that store large objects such as airplanes or farm, marine, and other heavy equipment.

Figure 2:
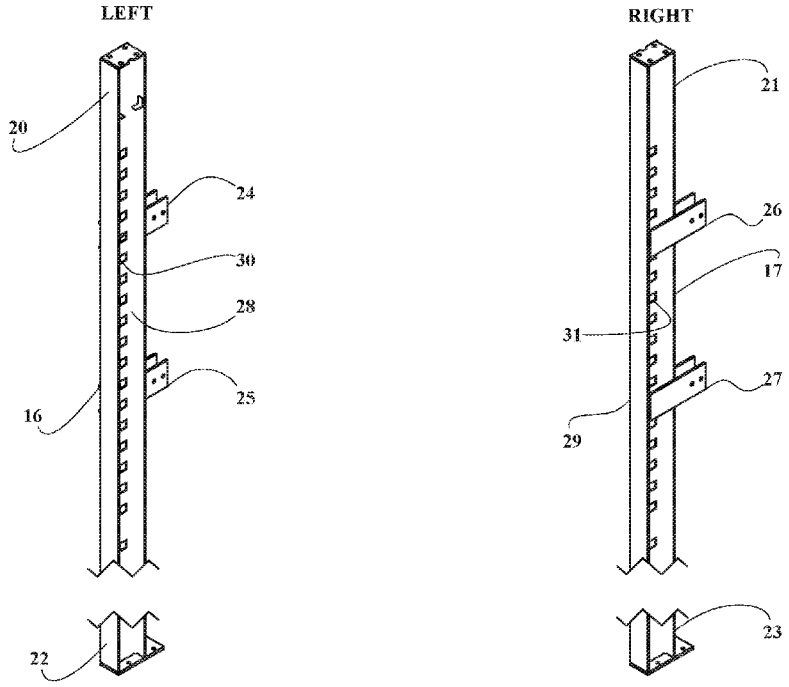
FIG. 2 is a perspective view illustrating columns of a lift frame for the door system.
Figure 3:
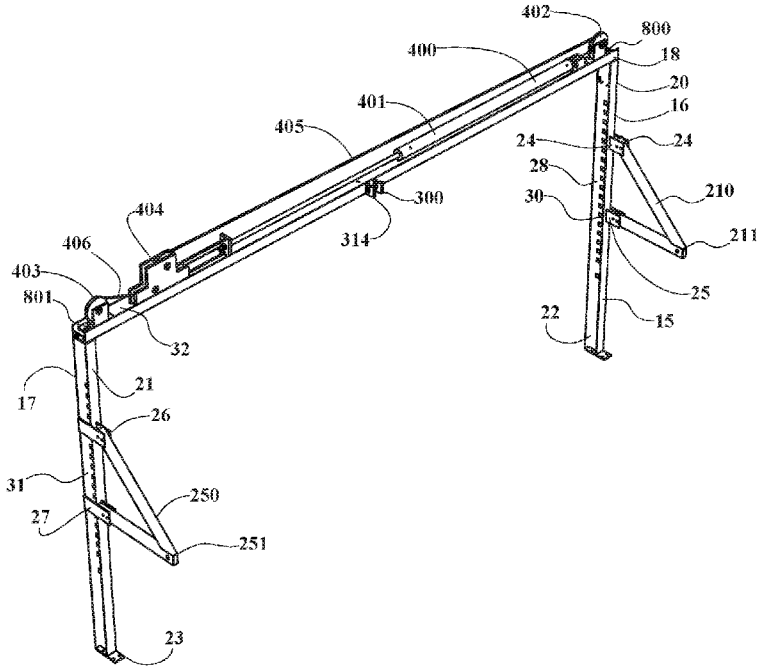
FIG. 3 is a perspective view illustrating the lift frame, an articulating arm system, and a drive system for the door system.
Figure 4:
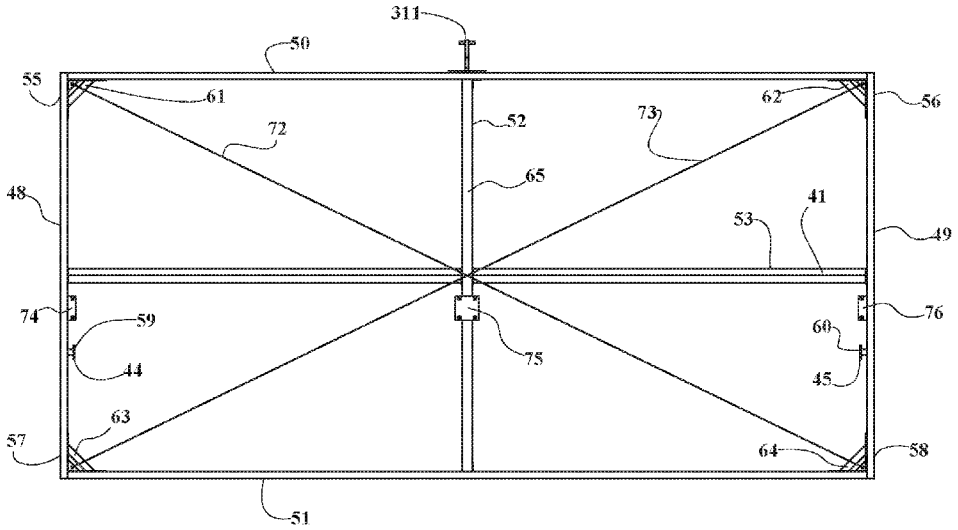
FIG. 4 is a front view illustrating a door for the door system.

FIGS. 2-3 illustrate the lift frame 15. The lift frame 15 can be part of a building's superstructure or can be a standalone frame designed to support the door 40, the lift frame 15 includes a header 18 secured between guide columns 16 and 17. The guide columns 16 and 17 and the header 18 can be made of any suitable material, however, in the preferred embodiment they are made of steel.

The guide column 16 includes a first end 20, a second end 22, support arm brackets 24 and 25 and a lift channel 28. The guide column 17 includes a first end 21, a second end 23, support arm brackets 26 and 27, and a lift channel 29. The support arm brackets 24 and 25 of the guide column 16 and the support arm brackets 26 and 27 of the guide column 17 secure the articulating arm system 200 to the lift frame 15. The lift channel 28 of the guide column 16 and the lift channel 29 of the guide column 17 receive the brake system 120 and include multiple brake apertures 30 and 31. The brake apertures 30 and 31 work in concert with the brake system 120 and their operation will be described in greater detail herein.

The header 18 includes a drive system channel 32, cable apertures 800 and 801, and a lock bracket 314. The header 18 secures between the first ends 20 and 21 of the guide columns 16 and 17 respectively using any suitable means such as welding. The drive system channel 32 of the header 18 receives the drive system 400. In addition, the cable apertures 800 and 801 of the header 18 allow cables 405 and 406 of the drive system 400 to pass through the header 18. The lock bracket 314 attaches to the header 18 using any suitable means such as welding or nuts and bolts. The lock bracket 314 is part of the lock system 300 and its operation will be explained in greater detail herein.

FIGS. 1, 4, 5, 11-14, and 15-20 illustrate the door 40. The door 40 includes a substructure 41 and support brackets 61-64. The door 40 resides within the lift frame 15 and is a tilt-up design that moves between a closed position and an open position. The drive system 400 and the control system 500 move the door 40 between its closed position and its open position. In the closed position, the door 40 is substantially parallel in relation to the lift frame 15, and secures to the lift frame 15 and the ground by the lock system 300. In moving from its closed position to its open position, the door 40 initially raises substantially vertically a predetermined distance. Once the door 40 travels the predetermined vertical distance, the door 40 tilts away from the lift frame 15 to a substantially perpendicular orientation in relation to the lift frame 15 while also rising relative to the lift frame 15 so that equipment can be placed within and removed from the building.

The substructure 41 of the door 40 includes vertical support beams 48 and 49, horizontal support beams 50 and 51, a support grid 52, and a support truss 53. In the preferred embodiment, the door 40 includes a skin that covers the vertical support beams 48 and 49, the horizontal support beams 50 and 51, and the support 52 grid. The skin conceals and protects equipment stored within the building when the door 40 is in its closed position and is made of aluminum, fiberglass, or other suitable material.

The vertical support beam 48 includes a first end 55, a second end 57, a lift pin stiffener 44, a lift pin aperture 59, a truss bracket 74 and a guide arm bracket 97. The vertical support beam 49 includes a first end 56, a second end 58, a lift pin stiffener 45, a lift pin aperture 60, a truss bracket 76, and a guide arm bracket 98. The truss bracket 74 and the truss bracket 76 secure to the vertical support beam 48 and 49 respectively using any suitable means such as welding. The lift pin aperture 59 receives the lift pin 42 and the lift pin aperture 60 receives the second lift pin. The lift pin stiffener 44 secures to the vertical support beam 48 and the lift pin stiffener 45 secures to the vertical support beam 49. Once, the lift pin aperture 59 receives the lift pin 42 and the lift pin aperture 60 receives the second lift pin, the lift pin stiffener 44 and 45 provide structural support for the lift pin 42, the second lift pin, and the door 40 as the door 40 moves between its closed and open positions.

Figure 5:
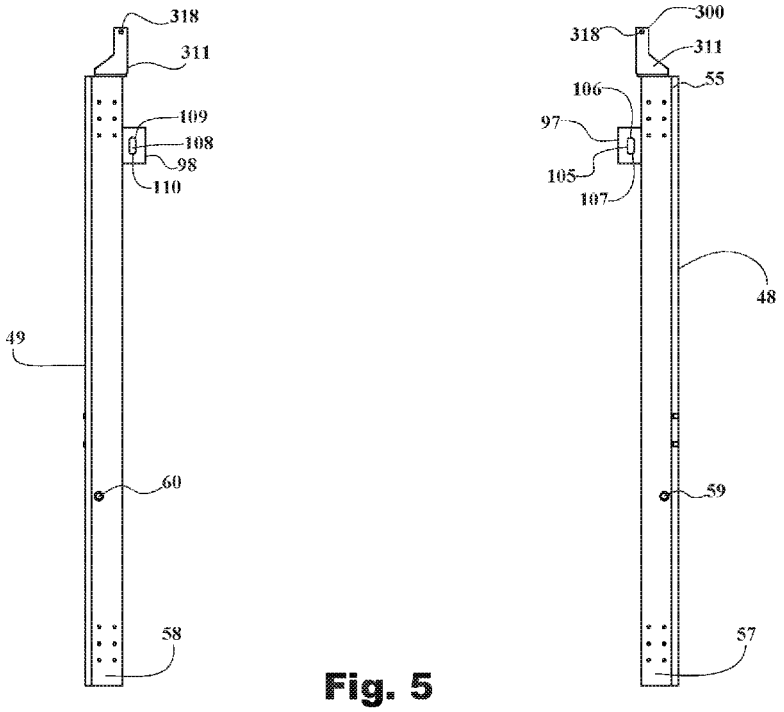
FIG. 5 is a side view illustrating vertical support beams of the door for the door system.

As illustrated in FIG. 5 the lift pin aperture 59 and the lift pin aperture 60 are positioned below the midpoint of the door 40, therefore the lift pin 42 and the second lift pin are positioned below the midpoint of the door 40. One of ordinary skill in the art will recognize that the lift pin 42 and the second lift pin may be positioned at any point along the door 40 depending upon the size of the articulating arm system 200 and a desired ratio of the door 40 being located inside versus outside of the lift frame 15 when raised. The lift pin 42 and the second lift pin allow the door 40 to be raised vertically and also to tilt horizontally. In particular, the drive system 400 acts upon the lift pin 42 and the second lift pin through the brake system 120 to raise and lower the door 40 vertically. Furthermore, the engagement of the lift pin 42 and the second lift pin with the brake system 120 allows the door 40 to tilt as the door 40 is raised and lowered vertically.

The guide arm bracket 97 of the vertical support beam 48 includes a slot 105, the slot 105 includes a first end 106 and a second end 107. The guide arm bracket 98 of the vertical support beam 49 includes a slot 108, the slot 108 includes a first end 109 and a second end 110. The guide arm bracket 97 and 98 engage the articulating arm system 200 and secure to the vertical support beam 48 and the vertical support beam 49 respectively using any suitable means such as welding or nuts and bolts.

The horizontal support beam 50 includes a latch 311 secured thereto using any suitable means such as welding or nuts and bolts. The horizontal support beam 51 includes lock pins 304 placed through a respective aperture 376 within the horizontal support beam 51. The latches 311 and the lock pins 304 are part of the lock system 300 and their operation will be explained in greater detail herein.

The horizontal support beam 50 secures between the first ends 55 and 56 of the vertical support beams 48 and 49 using any suitable means such as welding or nuts and bolts. The horizontal support beam 51 secures between the second ends 57 and 58 of the vertical support beams 48 and 49 using any suitable means such as welding or nuts and bolts. The support brackets 61-64 add structural support to the substructure 41 of the door 40 and secure to the vertical support beams 48 and 49 and the horizontal support beams 50 and 51 using any suitable means such as nuts and bolts.

The support grid 52 includes a vertical support brace 65 further including a truss bracket 75, horizontal support brace 71, a diagonal support cable 72, and a diagonal support cable 73. The vertical support brace 65 is placed at the midpoint between the vertical support beams 48 and 49 and secures between the horizontal support beams 50 and 51 using any suitable means such as welding or nuts and bolts. The horizontal support brace 71 is placed at the midpoint between horizontal support beams 50 and 51 and secures between the vertical support beams 48 and 49 using any suitable means such as welding or nuts and bolts. The diagonal support cable 72 secures to the first end 55 of the vertical support beam 48 and to the second end 58 of the vertical support beam 49 using any suitable means such as welding or nuts and bolts. The diagonal cable 73 secures to the first end 56 of the vertical support beam 49 and to the second end 57 of the vertical support beam 48 using any suitable means such as welding or nuts and bolts.

The support truss 53 connects to the truss brackets 74-76 using any suitable means such as welding or bolts. The support truss 53 prevents bending and bowing in the door 40 when the door 40 moves between its closed and open positions. In addition, the support truss 53 provides extra support against forces exerted on the door 40 by the wind.

FIGS. 6-9 illustrate the lift pin 42 and the brake assembly 121 of the brake system 120. The brake system 120 is a safety system designed to prevent the door 40 from closing abruptly in the event the drive system 400 fails. In addition, the brake system 120 connects the drive system 400 with the door 40. The brake system 120 includes a brake assembly 121 and a second brake assembly that move between a normally unlocked position and a locked position. The brake assembly 121 resides within the lift channel 28 of the guide column 16 and connects to the lift pin 42. The second brake assembly resides within the lift channel 29 of the guide column 17 and connects to the second lift pin. The brake assembly 121 and the second brake assembly move vertically within the lift channel 28 and the lift channel 29 respectively as the door 40 moves between its closed and its open positions. Further herein only the lift pin 42 and the brake assembly 121 will be described on the basis that the second lift pin and the second brake assembly include identical parts and operate in the same manner.

The lift pin 42 includes a first end 85 and a second end 87. The lift pin 42 inserts through the lift pin aperture 59 in the vertical support beam 48 of the door 40 and secures at the first end 85 to the lift pin stiffener 44 of the vertical support beam 48 using any suitable means such as a press fit or welding. The second end 87 of the lift pin 42 extends from the vertical support beam 48 and engages the brake assembly 121 of the brake system 120. The engagement of the lift pin 42 and the brake assembly 121 will be explained in greater detail herein.

The brake assembly 121 includes a lifting block 125, a linear bearing assembly 126, a safety brake 127, axles 128 and 129, and biasing members 130 and 131. The lifting block 125 includes a lift pin receiving slot 140, a cable-receiving aperture 141, biasing member receiving apertures 142 and 143, a linear bearing connection slot 144, a safety brake recess 145, an axle receiving aperture 146, axle securing apertures 147 and 148. The lift pin receiving slot 140 includes a bottom 190 and a top 191 and receives the lift pin 42. The linear bearing connection slot 144 includes a second end 192 and a first end 193 and receives a linear bearing connection bolt 149. The lifting block 125 moves vertically relative to the linear bearing assembly 126 as the brake assembly 121 moves between its normally unlocked position and its locked position.

The linear bearing assembly 126 includes a linear bearing 152, safety brake plates 153 and 154, and a mounting plate 155. The linear bearing 152 includes a lifting block attachment aperture 156 and a lift pin securing aperture 197. The lift pin securing aperture 197 receives and secures the lift pin 42 within the brake assembly 121. The safety brake plates 153 and 154 include axle receiving slots 160 and 161, axle securing apertures 162 and 163, and mounting plate securing apertures 164-167 respectively. The axle receiving slots 160 and 161 provide a forward position 194 and an aft position 195 for the axle 129. The mounting plate 155 includes brake plate attachment bores 168-171 and linear bearing apertures 172 and 173.

The safety brake 127 includes apertures 180 and 181 and a tooth 182 and moves between a retracted position and an extended position as the brake assembly 121 moves between its normally unlocked and locked positions. When the safety brake 127 is in its extended position, the tooth 182 of the safety brake 127 engages one of the brake apertures 30 of the guide column 16 thereby preventing the door 40 from closing. When the safety brake 127 is in its retracted position, the tooth 182 of the safety brake 127 disengages from the brake apertures 30 of the guide column 16 thereby allowing the door 40 to either open or close. The biasing members 130 and 131 include first ends and second ends and in the preferred embodiment are springs. The purpose of the biasing members 130 and 131 is to bias the brake assembly 121 into its locked position and the safety brake 127 into its extended position. The operation of the safety brake 127 will be explained in greater detail herein.

The brake assembly 121 assembles in the following manner. The safety brake plates 153 and 154 of the linear bearing assembly 126 are attached to the mounting plate 155 and secured by placing screws through the brake plate attachment bores 168-171 and into the mounting plate securing apertures 164-167. The mounting plate 155 with attached safety brake plates 153 and 154 is placed under the linear bearing 152 and secured to the linear bearing 152 by placing bolts through the bearing apertures 172 and 173 of the mounting plate 155 and into apertures located under the linear bearing 152.

After the mounting plate 155 with attached safety brake plates 153 and 154 is secured to the linear bearing 152, the linear bearing assembly 126 is aligned with the lifting block 125. Specifically, the lifting block attachment aperture 156 of the linear bearing 152 is aligned with the linear bearing connection slot 144 of the lifting block 125. The linear bearing connection bolt 149 is placed through the linear bearing connection slot 144 of the lifting block 125 and the lifting block attachment aperture 156 of the linear bearing 152. A nut secures to the linear bearing connection bolt 149 within the lifting block attachment aperture 156 thereby attaching the lifting block 125 to the linear bearing assembly 126.

The safety brake 127 is placed within the safety brake recess 145 of the lifting block 125 such that the aperture 180 aligns with the axle receiving aperture 146. The axle 128 is placed through the axle receiving aperture 146 of the lifting block 125 and the aperture 180 of the safety brake 127. Nuts are placed within the axle securing apertures 147 and 148 thereby securing the axle 128 and the safety brake 127 to the lifting block 125.

The aperture 181 of the safety brake 127 aligns with the axle receiving slots 160 and 161 of the safety brake plates 153 and 154. The axle 129 is placed through the axle receiving slot 160 of the safety brake plate 153, the aperture 181 of the safety brake 127, and the axle receiving slot 161 of the safety brake plate 154. Nuts are placed within the axle securing apertures 162 and 163 thereby securing the axle 129 and the safety brake 127 to the linear bearing assembly 126.

The first ends of the biasing members 130 and 131 are aligned with the biasing member receiving apertures 142 and 143 of the lifting block 125. Bolts are placed within the biasing member receiving apertures 142 and 143 thereby securing the first ends of the biasing members 130 and 131 to the lifting block 125. The second ends of the biasing member 130 and 131 are secured to the mounting plate 157 using any suitable means such as bolts thereby assembling the brake assembly 121. Once secured to the lifting block 125 and the mounting plate 157 respectively, the biasing members 130 and 131 move between a first position and a second position.

The assembled brake assembly 121 is placed within lift channel 28 of the guide column 16. The second end 87 of the lift pin 42 is placed through the lift pin receiving slot 140 of the lifting block 125 and into the lift pin securing aperture 197 of the linear bearing 152 thereby engaging the brake assembly 121 with the door 40. The cable 405 of the drive system 400 secures to the cable-receiving aperture 141 of the lifting block 125 using any suitable means such as nuts and bolts thereby engaging the brake assembly 121 with the drive system 400.

Figure 8:
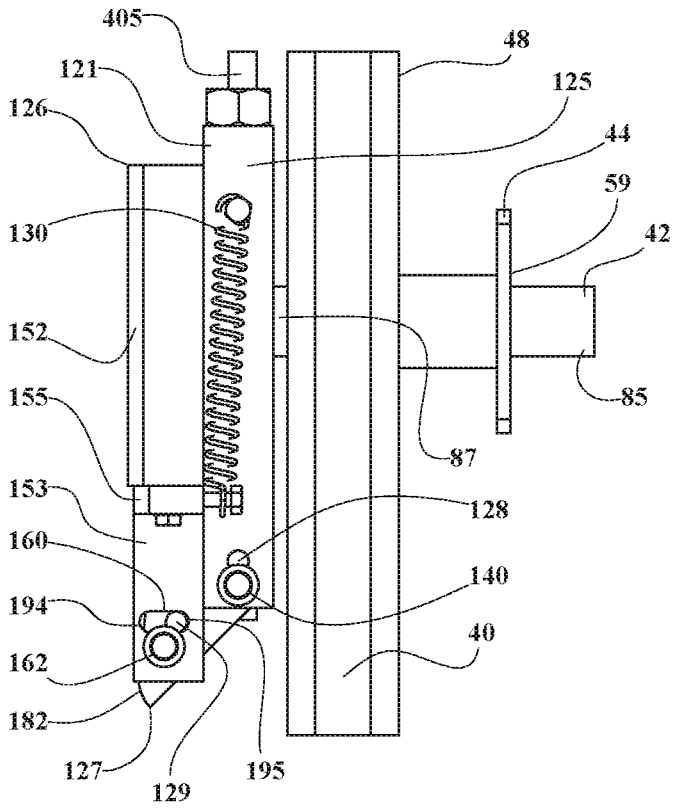
FIG. 8 is a side view illustrating the brake assembly in its normally unlocked position.

FIG. 8 illustrates the brake assembly 121 in its normally unlocked position. The attachment of the cable 405 between the brake assembly 121 and the drive system 400 maintains the drive system 400 under constant tension and creates a lifting force on the lifting block 125 that moves the lifting block 125 vertically upward relative to the linear bearing assembly 126, thereby placing the brake assembly 121 in its unlocked position. Specifically, as the lifting block 125 moves vertically upward, the lift pin receiving aperture 140 moves vertically upward such that the bottom 190 of the lift pin receiving aperture 140 engages the lift pin 42. In addition, the linear bearing connection slot 144 moves vertically upward such that the second end 192 of the linear bearing connection slot 144 engages the linear bearing connection bolt 149. Furthermore, as the lifting block 125 moves vertically upward relative to the linear bearing assembly 126, the axle 129 moves from the forward position 194 to the aft position 195 within the axle receiving slots 160 and 161, thereby moving the tooth 182 of the safety brake 127 from its extended position to its retracted position. When the tooth 182 of the safety brake 127 moves from its extended position to its retracted position, the tooth 182 disengages from the brake apertures 30 of the guide column 16 thereby allowing the door 40 to either open or close. The movement of the lifting block 125 vertically upward relative to the linear bearing assembly 126 imparts a restoring force into the biasing members 130 and 131 and moves the biasing members 130 and 131 to their first position.

Figure 9:
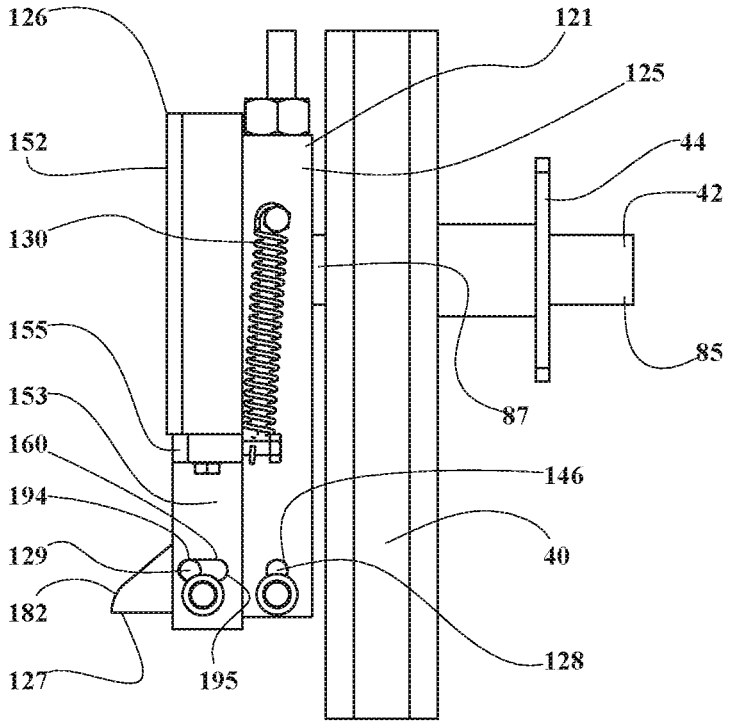
FIG. 9 is a side view illustrating the brake assembly in its locked position.
Figure 10:
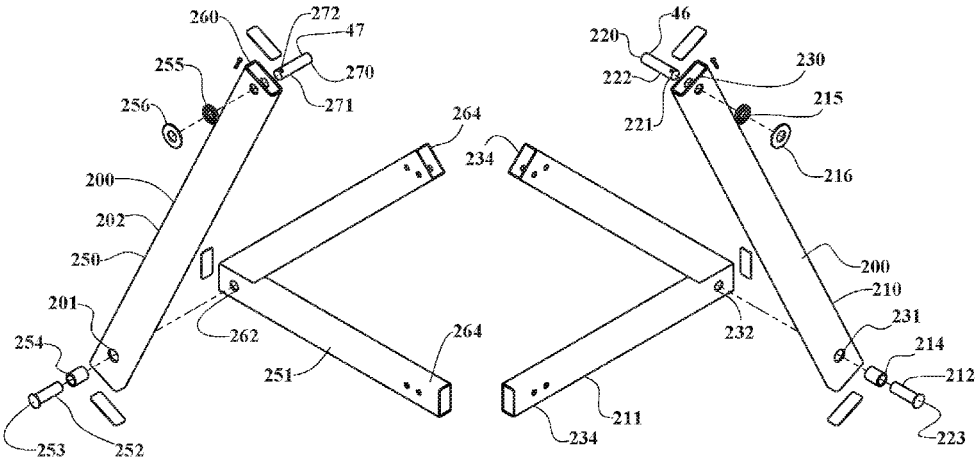
FIG. 10 is an exploded perspective view illustrating the articulating arm system for the door system.

FIG. 9 illustrates the brake assembly 121 in its locked position. The brake assembly 121 moves to its locked position upon a failure in the drive system 400, such as for example, if the cable 405 were to break. A failure in the drive system 400 releases the lifting force on the lifting block 125 such that restoring force imparted into the biasing members 130 and 131 moves the biasing members 130 and 131 from the first position to the second position. Moving the biasing members 130 and 131 from the first position to the second position moves the lifting block 125 vertically downward relative to the linear bearing assembly 126.

Specifically, as the lifting block 125 moves vertically downward the lift pin receiving aperture 140 moves vertically downward such that the top 190 of the lift pin receiving aperture 140 engages the lift pin 42. In addition, the linear bearing connection slot 144 moves vertically downward such that the first end 193 of the linear bearing connection slot 144 engages the linear bearing connection bolt 149. Furthermore, as the lifting block 125 moves vertically downward relative to the linear bearing assembly 126, the axle 129 moves from the aft position 195 to the forward position 194 within the axle receiving slots 160 and 161, thereby moving the tooth 182 of the safety brake 127 from its retracted position to its extended position. When the tooth 182 of the safety brake 127 moves from its retracted position to its extended position, the tooth 182 engages a nearest one of the brake apertures 30 of the guide column 16 thereby stopping the door 40 and preventing its closing.

FIGS. 10-14 illustrate the articulating arm system 200. The articulating arm system 200 includes an articulating arm assembly 201 and 202. The articulating arm system 200 guides the door 40 between its closed and open positions. Specifically, as the door 40 moves from its closed to its open position, the articulating arm system 200 guides the door 40 which is substantially parallel with the lift frame 15 vertically upward and then guides the door 40 away from the lift frame 15. In particular, the articulating arm system 200 tilts the door 40 away from the lift frame 15 until the door 40 reaches its open position, which, in the preferred embodiment, is substantially perpendicular with respect to the lift frame 15. Likewise, as the door 40 moves from its open to its closed position, the articulating arm system 200 guides the door 40 which is substantially perpendicular with the lift frame 15 toward the lift frame 15. In particular, the articulating arm system 200 tilts the door 40 toward the lift frame 15 until the door 40 is substantially parallel with the lift frame 15. After the door 40 is substantially parallel with the lift frame 15, the door 40 travels vertically downward thereby placing the door 40 into the closed position.

The articulating arm assembly 201 includes a guide arm 210, a support arm 211, a hinge pin 46, a hinge pin 212 including a screw aperture 223, bearings 214 and 215, and a washer 216. The guide arm 210 includes a hinge pin aperture 230 and a bearing aperture 231. The support arm 211 includes a hinge pin aperture 232 and lift frame ends 234. The hinge pin 46 includes a first end 220 and a second end 221 including a retaining clip aperture 222. The hinge pin 46 and the hinge pin 212 allow the guide arm 210 to rotate around an axis defined by the bearing aperture 231 of the guide arm 210. The guide arm 210 and the support arm 211 can be constructed from any suitable material, however, in the preferred embodiment they are constructed from tubular steel.

The articulating arm assembly 201 assembles in the following manner. The support arm 211 at the lift frame ends 234 attaches to support arm brackets 24 and 25 of the lift frame 15 using any suitable means such as nuts and bolts. The bearing 214 inserts within the bearing aperture 231 of the guide arm 210. The bearing aperture 231 with the inserted bearing 214 aligns with the hinge pin aperture 232 of the support arm 211. The hinge pin 212 inserts through bearing 214 and through the hinge pin aperture 232 of the support arm 211. A bolt inserts through the screw aperture 223 of the hinge pin 212 and secures with a nut, thereby coupling the guide arm 210 to the support arm 211. The hinge pin 46 inserts through the hinge pin aperture 230 of the guide arm 210 and secures therein at the first end 220 using any suitable means such as a press fit or welding. The bearing 215 and the washer 216 are placed over the hinge pin 46. After, the bearing 215 and the washer 216 are placed over the hinge pin 46, the hinge pin 46 engages and secures to the guide arm bracket 97 of the door 40 at the second end 221 via a retaining clip placed through the retaining clip aperture 222.

The articulating arm assembly 202 includes a guide arm 250, a support arm 251, a hinge pin 47, a hinge pin 252 including a screw aperture 253, bearings 254 and 255 and a washer 256. The guide arm 250 includes a hinge pin apertures 260 and a bearing aperture 261. The support arm 251 includes a hinge pin aperture 262 and lift frame ends 264. The hinge pin 47 includes a first end 270 and a second end 271 including a retaining clip aperture 272. The hinge pin 47 and the hinge pin 252 allow the guide arm 250 to rotate around an axis defined by the bearing aperture 261 of the guide arm 250. The guide arm 250 and the support arm 251 can be constructed from any suitable material, however, in the preferred embodiment they are constructed from tubular steel.

The articulating arm assembly 202 assembles in the following manner. The support arm 251 at the lift frame ends 264 attaches to support arm brackets 26 and 27 of the lift frame 15 using any suitable means such as nuts and bolts. The bearing 254 inserts within the bearing aperture 261 of the guide arm 250. The bearing aperture 261 with the inserted bearing 254 aligns with the hinge pin aperture 262 of the support arm 251. The hinge pin 252 inserts through bearing 254 and through the hinge pin aperture 262 of the support arm 251. A bolt inserts through the screw aperture 253 of the hinge pin 252 and secures with a nut, thereby coupling the guide arm 250 to the support arm 251. The hinge pin 47 inserts through the hinge pin aperture 260 of the guide arm 250 and secures therein at the first end 270 using any suitable means such as a press fit or welding. The bearing 255 and the washer 256 are placed over the hinge pin 47. After, the bearing 255 and the washer 256 are placed over the hinge pin 47, the hinge pin 47 engages and secures to the guide arm bracket 98 of the door 40 at the second end 271 via a retaining clip placed through the retaining clip aperture 272.

FIGS. 11-14 illustrate only the operation of the articulating arm assembly 201 of the articulating arm system 200 on the basis that the articulating arm assembly 201 and the articulating arm assembly 202 are identical and operate in the same manner. As the drive system 400 operates through the brake system 120 to move the door 40 from its closed position to its open position, the brake system 120 moves vertically upward and the door 40 begins rising vertically. As the door 40 rises vertically, the guide arm bracket 97, which initially contacts the hinge pin 46 at the first end 106 of the slot 105, also rises vertically such that the second end 107 of the slot 105 contacts the hinge pin 46. Once the second end 107 of the slot 105 contacts the hinge pin 46, the slot 105 of the guide arm bracket 97 rotates about the hinge pin 46 and the lift pin 42 rotates within the brake assembly 121 thereby rotating the door 40. As the door 40 rotates, the guide arm 210 guides the rotation of the door 40. In particular, the guide arm 210 of the articulating arm assembly 201 rotates around the bearing 214 such that the guide arm 210 rotates away from the lift frame 15 thereby tilting the door 40 away from the lift frame 15 until the brake assembly 121 and the lift pin 42 cease traveling vertically upward. When the brake assembly 121 and lift pin 42 cease traveling vertically upward, the door 40 will be in its open position, which in the preferred embodiment is substantially perpendicular in relation to the lift frame 15.

Figure 11:
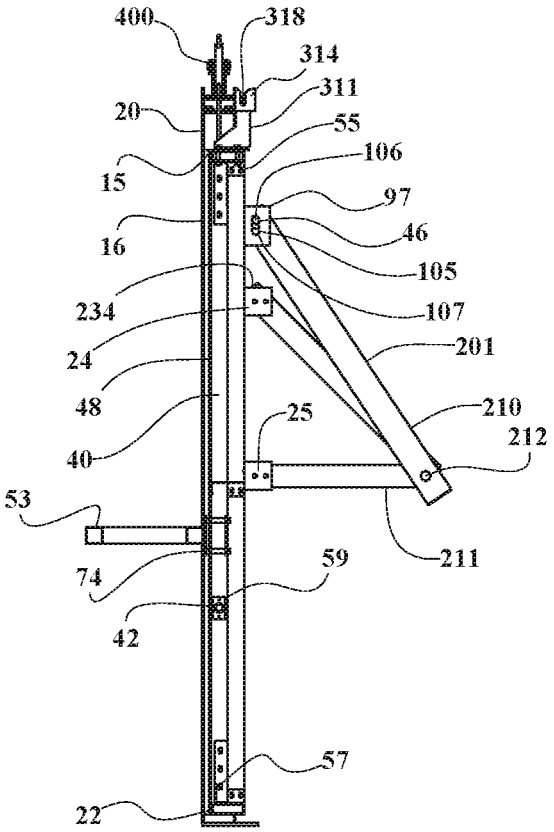
FIGS. 11-14 are side views illustrating an articulating arm assembly of the articulating arm system for the door system moving from a door closed to door open position.
Figure 12:
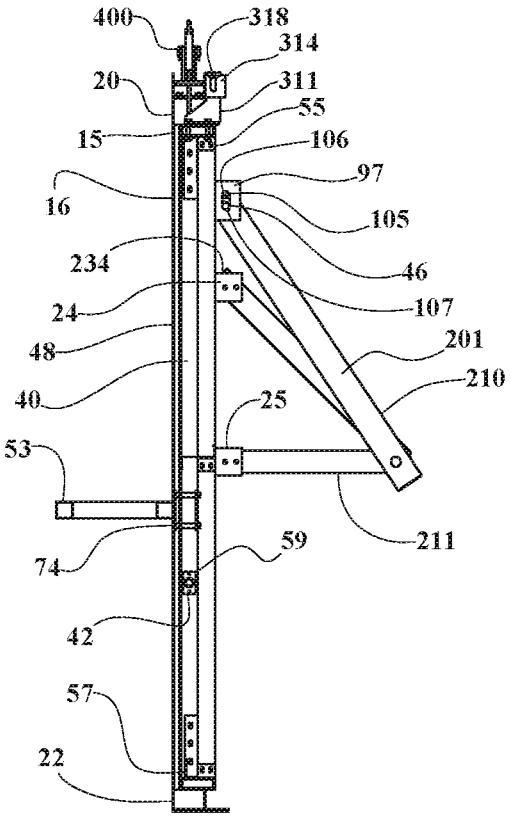
Figure 13:
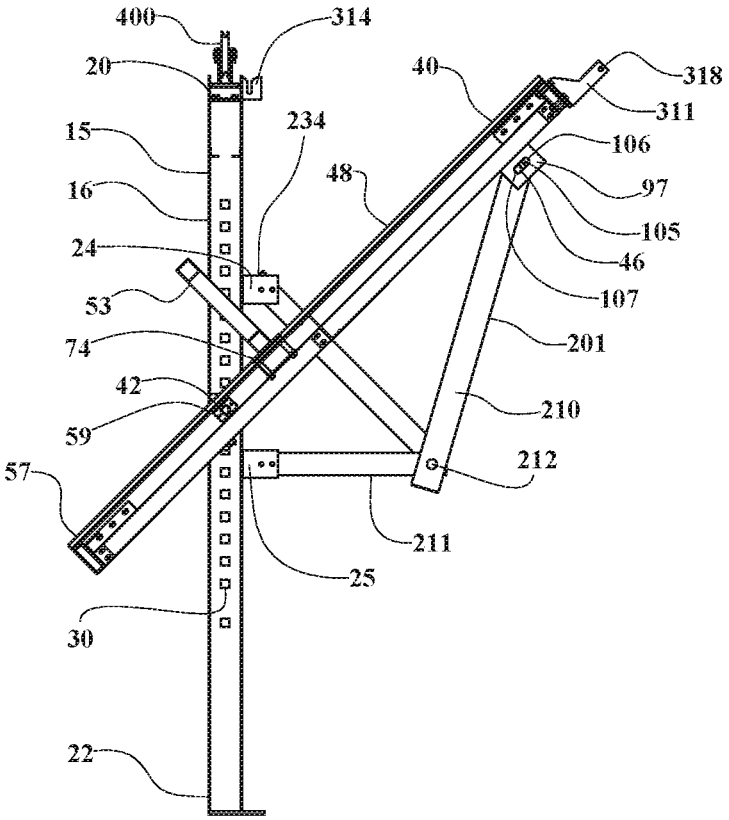
Figure 14:
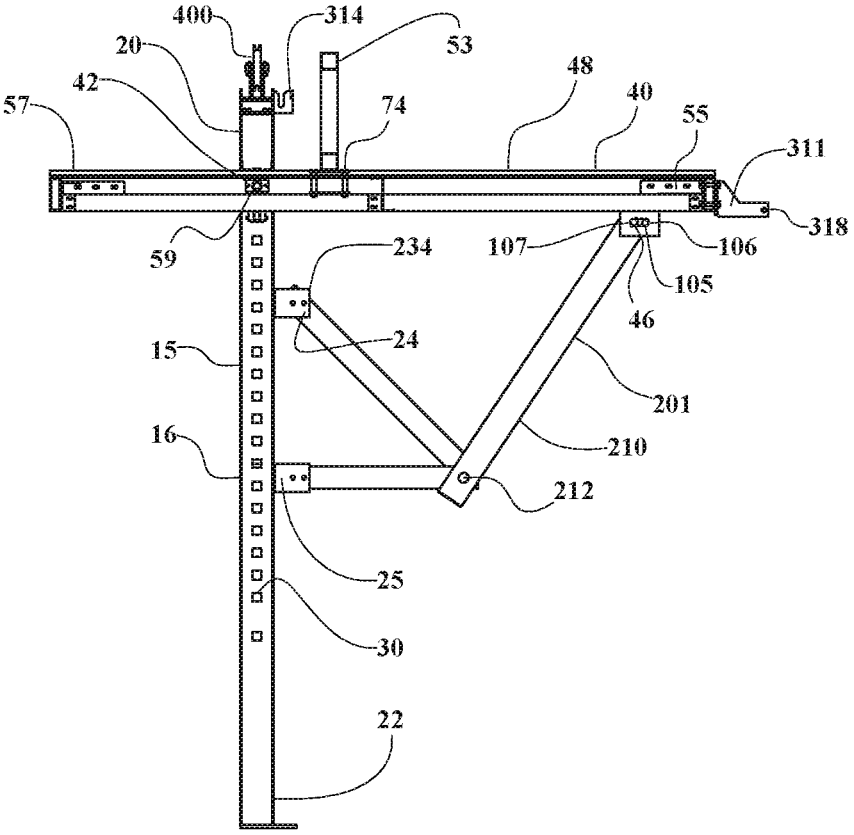

FIGS. 14-11 illustrate the articulating arm assembly 201 of the articulating arm system 200 as the door 40 moves vertically downward. As the drive system 400 operates through the brake system 120 to move the door 40 from its open position to its closed position, the brake system 120 moves vertically downward and the door 40 begins lowering vertically. As the door 40 lowers vertically, the guide arm bracket 97 rotates about the hinge pin 46 and the lift pin 42 rotates within the brake assembly 121 thereby rotating the door 40. As the door 40 rotates, the guide arm 210 guides the rotation of the door. In particular, the guide arm 210 of the articulating arm assembly 201 rotates around the bearing 214 such that the guide arm 210 rotates toward the lift frame 15 thereby tilting the door 40 to a substantially parallel position with the lift frame 15. After the door 40 reaches a substantially parallel position relative to the lift frame 15, the door begins traveling vertically downward. As the door 40 begins traveling vertically downward, the guide arm bracket 97, which currently contacts the hinge pin 46 at the second end 107 of the slot 105, also travels vertically downward such that the first end 106 of the slot 105 contacts the hinge pin 46. Once the hinge pin 46 contacts the first end 106 of the guide arm bracket 97, the brake assembly 121 and the lift pin 42 cease traveling vertically downward and the door 40 reaches its closed position.

FIGS. 15-20 illustrate the lock system 300 that stabilizes the door 40 and counter acts wind forces exerted on the door 40 when the door 40 is in its closed position. The lock system 300 includes the latch assembly 301 and the lock pins 304. While the preferred embodiment discloses one latch assembly 301 and lock pins 304, one of ordinary skill in the art will recognize that the lock system 300 may include any number of latch assemblies 301 and lock pins 304 depending upon system requirements.

The latch assembly 301 includes a latch 311 and the lock bracket 314. The latch 311 includes a body 317 and a pin 318. The body 317 of the latch 311 secures to the horizontal support beam 50 of the door 40 using any suitable means such as nuts and bolts. The lock bracket 314 includes a lock notch 324 that receives the pin 318 of the latch 311. In the preferred embodiment, the lock bracket 314 includes a rounded surface at the openings of the lock notch 324 that aid the pin 318 in entering and exiting the lock notch 324. The pin 318 of the latch 311 moves between a locked position and a released position within the lock notch 324.

The lock pins 304 include a shaft 355 and a head 356. The lock pins 304 insert through a respective aperture 376 within the horizontal support beam 51 of the door 40, and the shaft 355 of the lock pins 304 engages receiving cavities 354 located in the either the building foundation or the ground. The lock pins 304 move between a locked and unlocked position as the door 40 moves between its closed and open positions. In the preferred embodiment, the depth of the receiving cavity 354 is such that only a portion of the shaft 355 enters the receiving cavity 354. This secures the door 40 while leaving the lock pins 304 partially exposed so that the lock pins 304 may be easily removed from the door 40 if necessary.

Figure 17:
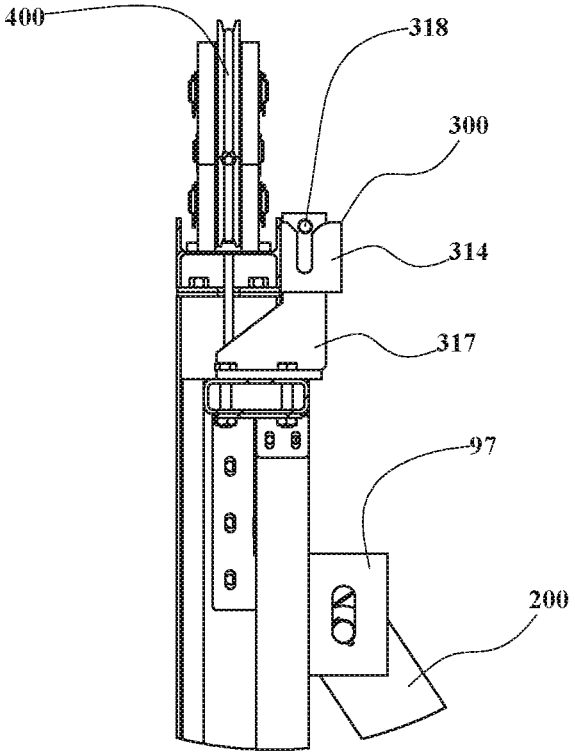
FIG. 17 is a side view illustrating a latch assembly of a lock system for the door system when the door transitions to an open position.
Figure 18:
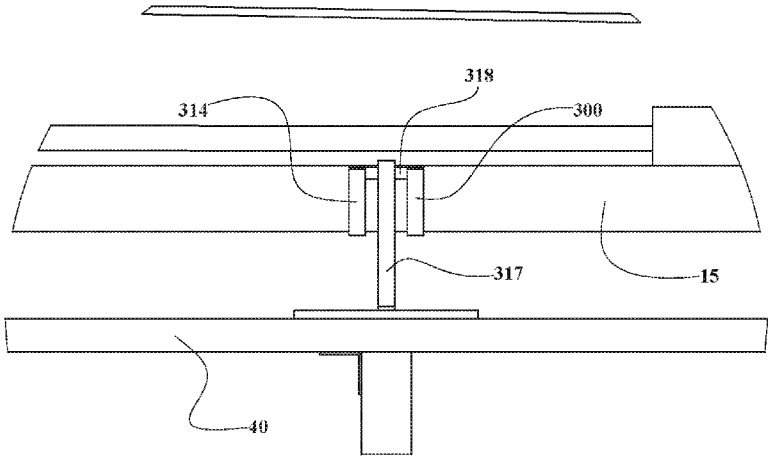
FIG. 18 is a front view illustrating a latch assembly of a lock system for the door system when the door transitions to an open position.
Figure 19:
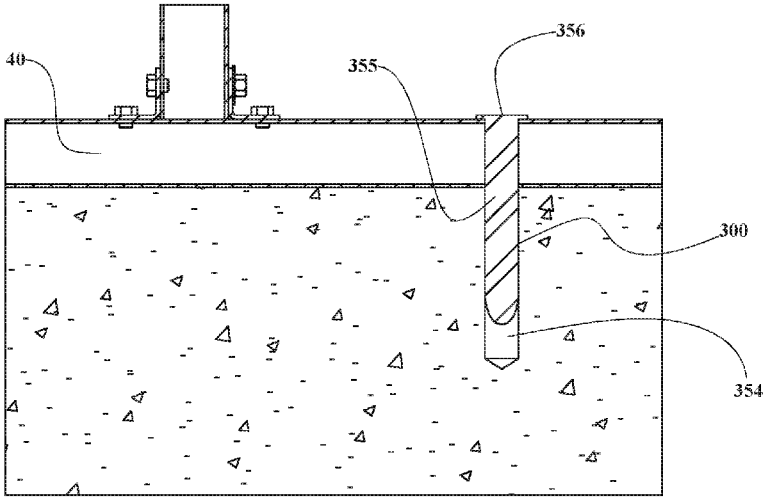
FIG. 19 is a front view illustrating a lock pin of a lock system for the door system when the door transition to the closed position.
Figure 20:
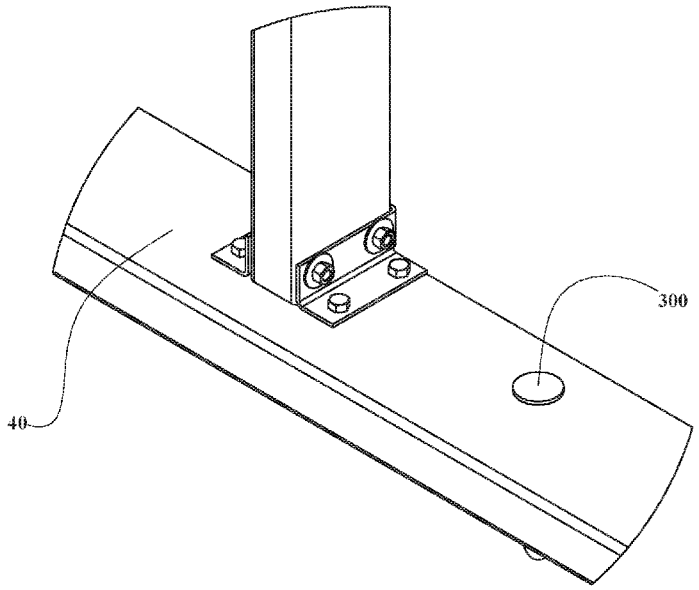
FIG. 20 is a perspective view illustrating a lock pin of a lock system for the door system when the door transition to the closed position.
Figure 21:
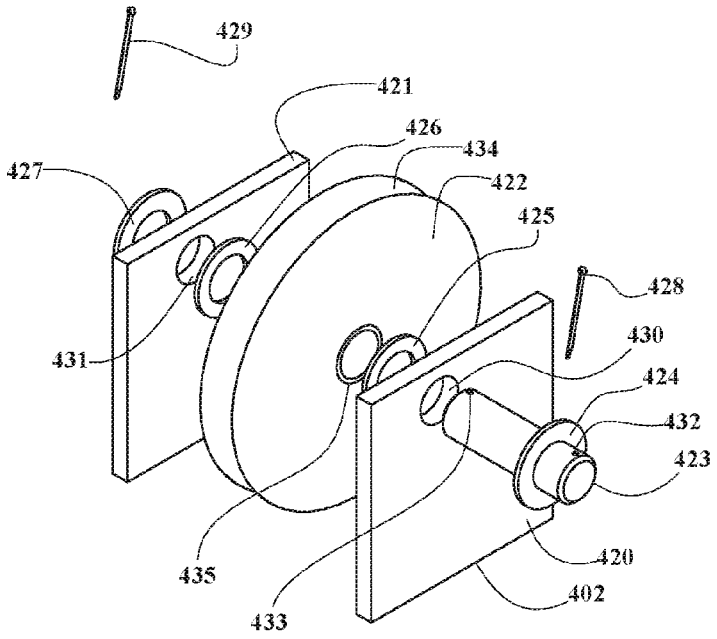
FIGS. 21-23 are perspective views illustrating a pulley assembly for the door system.
Figure 22:
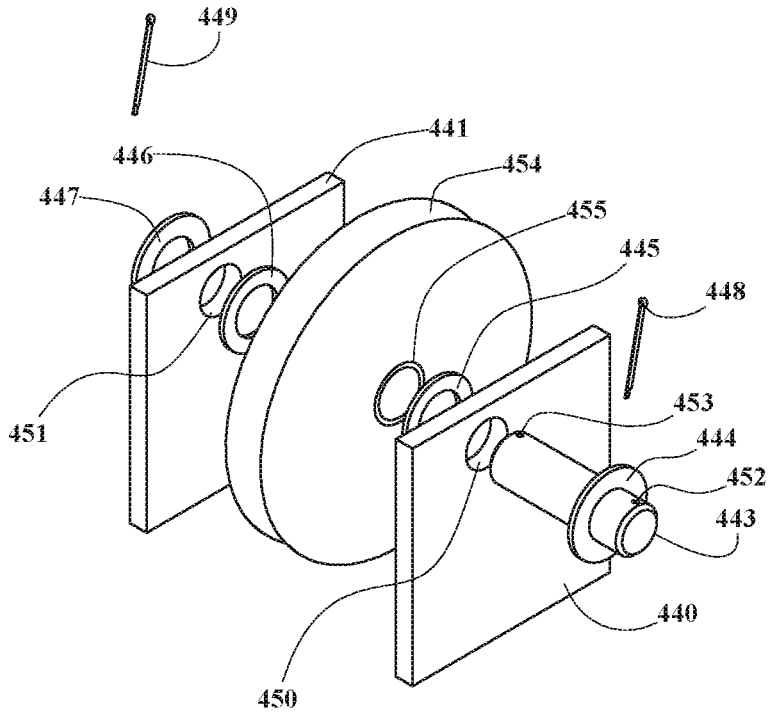
Figure 23:
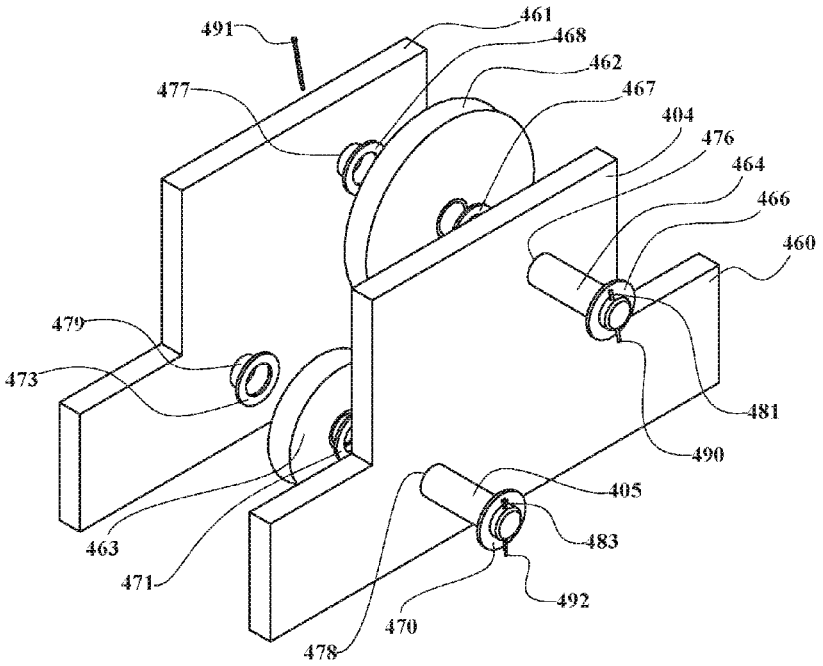

The operation of the lock assembly 300 during movement of the door 40 from its closed position, which is a substantially parallel position relative to the lift frame 15, to its open position will be described herein. As illustrated in FIGS. 17 and 18 as the door 40 moves vertically upward, the door 40 moves the pins 318 out of the lock notches 324 of the lock brackets 314 and to a location above the lock notches 324 that releases the door 40 from the lift frame 15 and allows further opening of the door 40 to its open position which is a substantially perpendicular position relative to the lift frame 15. Likewise, the vertical movement of the door 40 moves the lock pins 304 out of the receiving cavities 354 and to a location above the receiving cavities 354 that releases the door 40 from the building foundation or the ground and allows further opening of the door 40.

Figure 15:
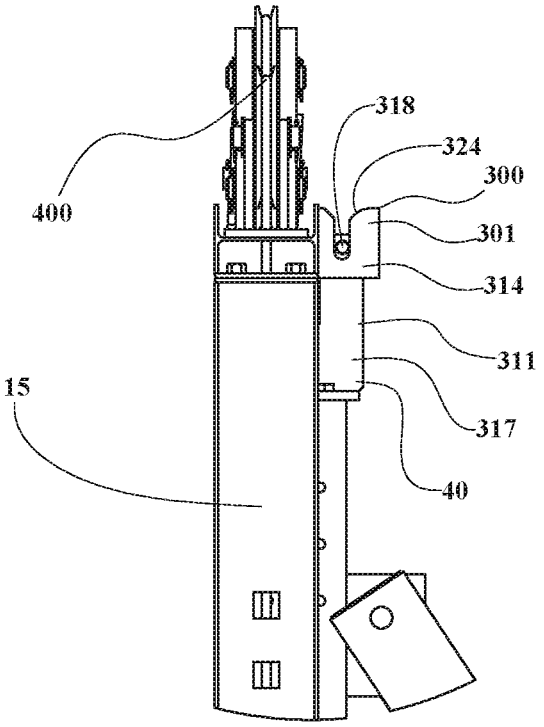
FIG. 15 is a side view illustrating a latch assembly of a lock system for the door system when the door is in a closed position.
Figure 16:
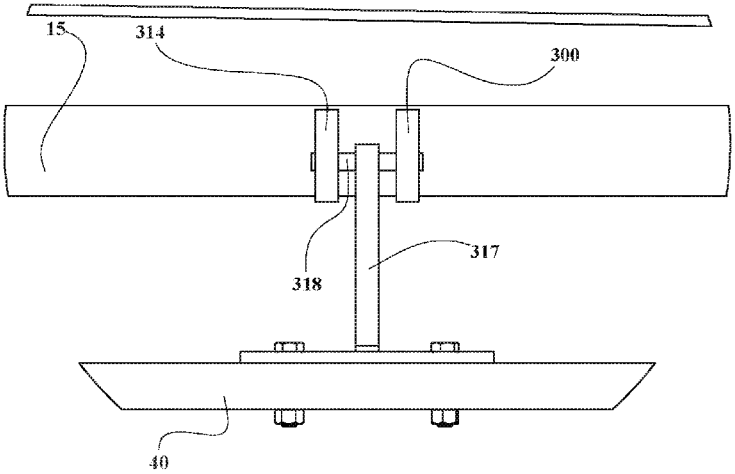
FIG. 16 is a front view illustrating a latch assembly of a lock system for the door system when the door is in a closed position.

The operation of the lock assembly 300 during movement of the door 40 from its open position, which is a substantially perpendicular position relative to the lift frame 15, to its closed position will be described herein. As the door 40 moves from its open position its closed position, the door 40 moves from a substantially perpendicular position relative to the lift frame 15 to a substantially parallel position relative to the lift frame 15. As illustrated in FIGS. 17 and 18, the movement of the door 40 to its substantially parallel position relative to the lift frame 15 locates the pin 318 above the lock notch 324 of the lock bracket 314. As illustrated in FIGS. 15 and 16, the continued downward movement of door 40 moves the pins 318 into the lock notches 324, thereby securing the door 40 to the lift frame 15. Likewise, movement of the door 40 to its substantially parallel position relative to the lift frame 15, locates the lock pins 304 above the receiving cavities 354, and the continued downward movement of the door 40 moves the lock pins 304 into the receiving cavities 354, thereby securing the door 40 to the building foundation or the ground.

FIGS. 1, 3, and 21-23 illustrate the drive system 400. The drive system 400 includes a driver 401, pulley assemblies 402-404, and cables 405 and 406. The drive system 400 may include its own frame that secures to the header 23, however, in the preferred embodiment, the driver 401 and the pulley assemblies 402-404 of the drive system 400 are secured within the drive system channel 32 of the header 23. The drive system 400 moves the door 40 between its closed and its open positions and is operated by the control system 500. In the preferred embodiment, the drive system 400 operates under constant tension through its coupling with the door 40 via the cables 405 and 406. The weight of the door 40 pulling against the drive system 400 constantly tensions the drive system 400 such that the brake assembly 121 and the second brake assembly are maintained in their normally unlocked positions.

The driver 401 may be any suitable device for powering the door system 10 such as a hydraulic cylinder, pneumatic cylinder, or electric motor. In the preferred embodiment, the drive system 401 is a hydraulic cylinder including a cylinder barrel and piston rod. Retraction and extension of the piston rod relative to the cylinder barrel moves the driver 401 between an extended first position wherein the door 40 is closed and a retracted second position wherein the door 40 is open. The driver 401 includes a body-mounting bracket 410 that secures the cylinder barrel within the drive system channel 32 of the header 23. The driver 401 further includes a shaft-mounting bracket 411 located within the drive system channel 32 and connected with the piston rod. The shaft-mounting bracket 411 moves within the drive system channel 32 as the driver 401 moves between its extended and retracted positions.

The pulley assembly 402 includes plates 420 and 421, a pulley 422, an axle 423, washers 424-427 and pins 428 and 429. The plates 420 and 421 include apertures 430 and 431, and the axle 423 includes receiving apertures 432 and 433. The pulley 422 includes a cable receiving channel 434 and a bearing 435. The pulley assembly 402 is assembled in the following manner. The axle 423 is placed through the washers 424-427, the aperture 430 and 431, and the bearing 435 of the pulley 422. The pins 428 and 429 are placed within the receiving apertures 432 and 433 of the axle 462 thereby securing the pulley 422 to the plates 420 and 421. After the pulley 422 secures to the plates 420 and 421, the pulley assembly 402 is ready to be attached to the drive system channel 32 of the header 23. The pulley assembly 402 is placed adjacent to the cable aperture 800 of the header 23 and attached using any suitable means such as welding or nuts and bolts.

The pulley assembly 403 includes plates 440 and 441, a pulley 442, an axle 443, washers 444-447 and pins 448 and 449. The plates 440 and 441 include apertures 450 and 451, and the axle 443 includes receiving apertures 452 and 453.

The pulley 442 includes a cable receiving channel 454 and a bearing 455. The pulley assembly 403 is assembled in the following manner. The axle 442 is placed through the washers 444-447, the aperture 450 and 451, and the bearing 455 of the pulley 442. The pins 448 and 449 are placed within the receiving apertures 452 and 453 of the axle 443 thereby securing the pulley 442 to the plates 440 and 441. After the pulley 442 secures to the plates 440 and 441, the pulley assembly 403 is ready to be attached to the drive system channel 32 of the header 23. The pulley assembly 403 is placed adjacent to the cable aperture 801 of the header 23 and attached using any suitable means such as welding or nuts and bolts.

The pulley assembly 404 includes plates 460 and 461, pulleys 462 and 463, axles 464 and 465, washers 466-473 and pins 490-493. The plates 460 and 461 include apertures 476-479, and the axles 464 and 465 include receiving apertures 480-483. The pulleys 462 and 463 include cable receiving channel 484 and 485 and bearings 486 and 487. The pulley assembly 404 is assembled in the following manner. The axle 464 is placed through the washers 466-469, the aperture 476 and 477, and the bearing 486 of the pulley 462. The axle 465 is placed through the washers 470-473, the aperture 478 and 479, and the bearing 487 of the pulley 462. The pins 490-493 are placed within the receiving apertures 480-483 of the axles 464 and 465 thereby securing the pulleys 462 and 463 to the plates 460 and 461. After the pulleys 462 and 463 secure to the plates 460 and 461, the pulley assembly 404 is ready to be attached to the drive system channel 32 of the header 23. The pulley assembly 404 is placed adjacent to the shaft-mounting bracket 411 of the driver 401 when the driver 401 is in its extended position, and attached using any suitable means such as welding or bolts.

The cables 405 and 406 connect the drive system 400 to the brake system 120. The cable 405 secures at a first end to the brake assembly 121 of the brake system 120. A second end of the cable 405 then feeds through the cable aperture 800 of the header 23 and engages the pulley assembly 402. Specifically, the cable 405 is placed within the cable-receiving channel 434 of the pulley 422. The cable 405 then moves to engage the pulley assembly 404. In particular, the cable 405 is placed around the pulley 462 and within the cable-receiving channel 484, which redirects the cable 405 towards the driver 401. The cable 405 then secures at the second end to the shaft-mounting bracket 411 of the driver 401.

The cable 406 secures at a first end to the second brake assembly of the brake system 120. A second end of the cable 406 then feeds through the cable aperture 801 of the header 23 and engages the pulley assembly 403. Specifically, the cable 406 is placed within the cable-receiving channel 454 of the pulley 442. The cable 405 then moves to engage the pulley assembly 404. In particular, the cable 406 is placed under the pulley 463 and within the cable-receiving channel 485. The cable 406 then secures at the second end to the shaft-mounting bracket 411 of the driver 401. Once the cables 405 and 406 secure to the brake system 120 and the shaft-mounting bracket 411 of the driver 401, the drive system 400 is capable of moving the door 40 between its closed position and its open position.

The drive system 400 operates in the following manner to move the door 40 from its closed to its open position. When the door 40 is in its closed position, the driver 401 of the drive system 400 is in its extended position. Upon activation by the control system 500, the driver 401 of the drive system 400 moves from its extended to its retracted position. As the driver 401 moves from its extended to its retracted position, the shaft-mounting bracket 411 moves within the drive system channel 32 of the header 18. The cables 405 and 406 translate the retraction of the driver 401 and the movement of the shaft-mounting bracket 411 to the door 40 resulting in the door 40 traveling from its closed position to its open position. In particular and responsive to the retraction of the driver 401, the cables 405 and 406 as redirected by the pulley assemblies 402-404 apply an upward pulling force on the brake system 120. Specifically, the upward pulling force exerted on the brake system 120 is directed into the brake assembly 121 and the second brake assembly. Furthermore, the upward pulling force exerted on the brake system 120 is directed into the lift pin 42 and the second lift pin which begin traveling vertically upward. The upward movement of the lift pin 42 and the second lift pin as well as the brake assembly 121 and the second brake assembly begins moving the door 40 vertically upward. The brake assembly 121, the second brake assembly, lift pin 42, and the second lift pin, continue to move vertically upward until the driver 401 reaches its retracted position. As previously described, the movement of the lift pin 42, the second lift pin, the brake assembly 121, and the second brake assembly vertically upward moves the door 40 from its closed position, which is substantially parallel relative to the lift frame 15, to its open position, which is substantially perpendicular relative to the lift frame 15.

The drive system 400 operates in the following manner to move the door 40 from its open to its closed position. When the door 40 is in its open position, the driver 401 of the drive system 400 is in its retracted position. Upon activation by the control system 500, the driver 401 of the drive system 400 moves from its retracted position to its extended position. As the driver 401 moves from its extended to its retracted position, the shaft-mounting bracket 411 moves within the drive system channel 32 of the header 18. The cables 405 and 406 translate the extension of the driver 401 and the movement of the shaft-mounting bracket 411 to the door 40 resulting in the door 40 traveling from its open position to its closed position. In particular and responsive to the extension of the driver 401, the cables 405 and 406 as redirected by the pulley assemblies 402-404 cease applying an upward pulling force on the brake system 120 resulting in the brake assemblies 121 and the second brake assembly traveling vertically downward. Furthermore, the lift pin 42 and the second lift pin travel vertically downward. The downward movement of the brake assembly 121, the second brake assembly, lift pin 42, and the second lift pin, respectively, begin moving the door 40 vertically downward. The brake assembly 121, the second brake assembly, the lift pin 42, and the second lift pin will continue to move vertically downward until the driver 401 reaches its extended position. As previously described, the movement of the brake assembly 121, the second brake assembly, the lift pin 42, and the second lift pin vertically downward moves the door 40 from its open position, which is substantially perpendicular relative to the lift frame 15, to its closed position, which is substantially parallel relative to the lift frame 15.

FIG. 24 illustrates a block diagram of the control system 500 for the driver 401. While the control system 500 in the preferred embodiment controls a hydraulic cylinder, one of ordinary skill in the art will recognize that a control system for a pneumatic cylinder or electric motor would be within the scope of the present invention. The control system 500 includes a controller 501, a pump motor controller 502, a pump 504, a hydraulic fluid tank 505, a hydraulic valve 506, open limit switch 507, close limit switch 508, an open control input 509, and close control input 510.

The controller 501 may be of any type microcontroller, CPU, microprocessor, and the like suitable to control the control system 500. The controller 501 connects to the motor controller 502, the hydraulic valve 506, the open limit switch 507, the close limit switch 508, the open control input 509, and the close control input 510. The controller 501 monitors the open control input 509 and the close control input 510 for user inputs requesting the opening or closing of the door 40. The controller 501 further controls the pump motor controller 502 and the hydraulic valve 506 in order to open or close the door 40. In addition, the controller 501 monitors the open limit switch 507 and the close limit switch 508 for outputs indicating the door 40 has reached its open or its closed position, respectively. Once the door 40 reaches its open position, it contacts the open limit switch 507 resulting in the open limit switch 507 outputting a cease opening signal to the controller 501. Likewise, once the door 40 reaches its closed position, it contacts the close limit switch 508 resulting in the close limit switch 508 outputting a cease closing signal to the controller 501.

The pump motor controller 502 controls the operation of the pump 504. Specifically, the pump motor controller 502 connects to the pump 504, which, in turn, connects to the hydraulic fluid tank 505. Upon activation by the pump motor controller 502, the pump 504 pumps hydraulic fluid from the hydraulic fluid tank 505 into the driver 401. Pumping hydraulic fluid into the driver 401 allows the door 40 to move from its closed to its open position.

The hydraulic valve 506 controls the flow of hydraulic fluid from the driver 401 during the closing of the door 40. Specifically, the hydraulic valve 506 is normally closed to prevent hydraulic fluid from exiting the driver 401 during the retraction of the driver 401 and the opening of the door 40. The hydraulic valve 506 however opens to allow hydraulic fluid to exit the driver 401 during the extension of the driver 401 and the closing of the door 40. Furthermore, the hydraulic valve 506 controls the flow of hydraulic fluid exiting the driver 401 thereby controlling the rate at which the driver 401 moves from its retracted to its extended position. Controlling the rate at which the driver 401 moves from its retracted to its extended position allows the door 40 to close at a controlled and safe rate.

The control system 500 operates in the following manner to move the door 40 from its closed to its open position. The controller 501 monitors the open control input 509 for a user input indicating a command to open the door 40. In the preferred embodiment, the open control input 509 is a push button that when engaged delivers a signal to the controller 501 indicating a command to open the door 40. The push button switch may require continuous engagement during the opening of the door 40 or alternatively may require a single actuation. Upon receiving an input to open the door 40, the controller 501 ensures the hydraulic valve 506 is closed. The controller 501 further outputs a command to the pump motor controller 502, which, in turn activates the pump 504. The pump 504 pumps hydraulic fluid out of the hydraulic fluid tank 505 and into the driver 401. As hydraulic fluid moves from the hydraulic fluid tank 505 and into the driver 401, the driver 401 moves from its extended to its retracted position thereby allowing the door 40 to open. In addition, the controller 501 monitors the open limit switch 507 to determine when the door 40 has reached the open position. Once the door 40 reaches its open position, it contacts the open limit switch 507 resulting in the open limit switch 507 outputting a signal to the controller 501 indicating the door 40 has reached its open position. Upon receipt of the signal, the controller 501 commands the pump motor controller 502 to deactivate the pump 504 thereby ceasing movement of the door 40.

The control system 500 operates in the following manner to move the door from its open to its closed position. The controller 501 monitors the close control input 510 for a user input indicating a command to close the door 40. In the preferred embodiment, the close control input 510 is a push button that when engaged delivers a signal to the controller 501 indicating a command to close the door 40. The push button switch may require continuous engagement during the closing of the door 40 or alternatively may require a single actuation. Upon receiving an input to close the door 40, the controller 501 outputs a command opening the hydraulic valve 506. After the hydraulic valve 506 opens, hydraulic fluid exits the driver 401, passing through the hydraulic valve 506 and into the hydraulic fluid tank 505. As hydraulic fluid moves from the driver 401 and into the hydraulic fluid tank 505, the driver 401 moves from its retracted to its extended position thereby allowing the door 40 to close. In the preferred embodiment, the door 40 closes due to gravity and its weight extends the driver 401 moving the driver 401 from its retracted to its extended position.

In addition, the controller 501 monitors the close limit switch 508 to determine when the door 40 has reached its closed position. When the door 40 reaches its closed position, it contacts the close limit switch 508, resulting in the close limit switch 508 outputting a signal to the controller 501 indicating the door 40 has reached its closed position. Upon receipt of the signal, the controller 501 closes the hydraulic valve 506 thereby preventing hydraulic fluid from exiting the driver 401 and ceasing movement of the door 40.

The preferred embodiment may include a stop control input. Activation of the stop control input would signal the controller 501 to stop the opening or closing of the door 40. In particular, the controller 501 would operate the pump motor controller 502 to deactivate the pump 504 or close the hydraulic valve 506. Alternatively, release of a continuous activation open control input 509 or a continuous activation close control input 510 would likewise stop the opening or the closing of the door 40.

The door system 10 operates in the following manner to move the door 40 from its closed position to its open position. The controller 501 monitors the open control input 509 for a user input indicating a command to open the door 40. Upon receiving an input to open the door 40, the controller 501 ensures the hydraulic valve 506 is closed. The controller 501 further outputs a command to the pump motor controller 502, which, in turn activates the pump 504. The pump 504 pumps hydraulic fluid out of the hydraulic fluid tank 505 and into the driver 401 of the drive system 400.

As the hydraulic fluid is pumped into the driver 401 of the drive system 400, the driver 401 moves from its extended to it retracted position. When the driver 401 moves from its extended to its retracted position, the shaft-mounting bracket 411 moves within the drive system channel 32 of the header 18. The cables 405 and 406 translate the retraction of the driver 401 and the movement of the shaft-mounting bracket 411 to the door 40 resulting in the door 40 traveling from its closed position to its open position. In particular and responsive to the retraction of the driver 401, the cables 405 and 406 as redirected by the pulley assemblies 402-404 apply an upward pulling force on the brake system 120. Specifically, the upward pulling force exerted on the brake system 120 is directed into the brake assembly 121 and the second brake assembly, thereby exerting upward pulling force on the lift pin 42 and the second lift pin respectively. The upward pulling force exerted on the brake system 120 begins moving the brake assembly 121, the second brake assembly, the lift pin 42, and the second lift pin vertically upward. The upward movement of the brake assembly 121, the second brake assembly, the lift pin 42, and the second lift pin, respectively, begin moving the door 40 vertically upward.

As the door 40 begins moving vertically upward, the door 40 is disengaged from the lock system 300. In particular, once the door 40 moves vertically upward, the door 40 moves the pin 318 out of the lock notch 324 of the lock bracket 314 and to a location above the lock notch 324 that releases the door 40 from the lift frame 15 and allows further opening of the door 40. Likewise, the vertical movement of the door 40 moves the lock pins 304 out of the receiving cavities 354 and to a location above the receiving cavities 354 that releases the door 40 from the building foundation or the ground and allows further opening of the door 40.

After disengaging from the lock system 300, the door 40 continues moving vertically upward wherein the articulating arm system 200 guides the door 40 from a substantially parallel position relative to the lift frame 15 to its open position which is substantially perpendicular relative to the lift frame 15.

As the door 40 moves vertically upward, the guide arm bracket 97, which initially contacts the hinge pin 46 at the first end 106 of the slot 105, also rises vertically such that the second end 107 of the slot 105 contacts the hinge pin 46. In addition, the guide arm bracket 98, which initially contacts the hinge pin 47 at the first end 109 of the slot 108, also rises vertically such that the second end 110 of the slot 108 contacts the hinge pin 47. Once the second end 107 of the slot 105 contacts the hinge pin 46 and the second end 110 of the slot 108 contacts the hinge pin 47, the slot 105 and the slot 108 of the guide arm bracket 97 and the guide arm bracket 98 rotate about the hinge pin 46 and the hinge pin 47 respectively. In addition, the lift pin 42 rotates within the brake assembly 121 and the second lift pin rotates within the second brake assembly thereby rotating the door 40.

As the door 40 rotates, the guide arm 210 and the guide arm 250 guide the rotation of the door 40. In particular, the guide arm 210 of the articulating arm assembly 201 and the guide arm 250 of the articulating arm assembly 202 rotate around their respective bearings 214 and 254 such that the guide arms 210 and 250 rotate away from the lift frame 15 resulting in the door 40 tilting away from the lift frame 15 and continuing to tilt away from the lift frame 15 until the brake assembly 121 with the attached lift pin 42 and the second brake assembly with the attached second lift pin cease traveling vertically upward. When the brake the brake assembly 121 with the attached lift pin 42 and the second brake assembly with the attached second lift pin cease traveling vertically upward, the door 40 will be in its open position, which in the preferred embodiment is substantially perpendicular in relation to the lift frame 15.

Furthermore, as the door 40 is moving from its closed to its open position, the controller 501 monitors the open limit switch 507 to determine when the door 40 has reached its open position. Once the door 40 reaches its open position, it contacts the open limit switch 507 resulting in the open limit switch 507 outputting a signal to the controller 501 indicating the door 40 has reached its open position. Upon receipt of the signal, the controller 501 commands the pump motor controller 502 to deactivate the pump 504 thereby ceasing movement of the door 40.

The door system 10 operates in the following manner to move the door 40 from its open position to its closed position. The controller 501 monitors the close control input 510 for a user input indicating a command to close the door 40. Upon receiving an input to close the door 40, the controller 501 outputs a command opening the hydraulic valve 506. After the hydraulic valve 506 opens, hydraulic fluid exits the driver 401, passing through the hydraulic valve 506 and into the hydraulic fluid tank 505. As hydraulic fluid moves from the driver 401 and into the hydraulic fluid tank 505, the driver 401 of the drive system 400 moves from its retracted to its extended position thereby allowing the door 40 to close.

As hydraulic fluid moves from the driver 401 and into the hydraulic fluid tank 505, the door 40 closes due to gravity and its weight extends the driver 401 moving the driver 401 from its retracted to its extended position. When the driver 401 moves from its retracted position to its extended position, the shaft-mounting bracket 411 moves within the drive system channel 32 of the header 18. The cables 405 and 406 translate the extension of the driver 401 and the movement of the shaft-mounting bracket 411 to the door 40 resulting in the door 40 traveling from its open position to its closed position. In particular and responsive to the extension of the driver 401, the cables 405 and 406 as redirected by the pulley assemblies 402-404 cease applying an upward pulling force on the brake system 120 resulting in the brake assembly 121, the second brake assembly, the lift pin 42, and the second lift pin traveling vertically downward. The downward movement of the brake assembly 121, the second brake assembly, the lift pin 42, and the second lift pin, respectively, begin moving the door 40 vertically downward.

Once the door 40 begins moving vertically downward, the articulating arm system 200 guides to the door 40 from it open position which is substantially perpendicular relative to the lift frame 15 to a substantially parallel position relative to the lift frame 15. In particular, the downward movement of the brake assembly 121, the second brake assembly, the lift pin 42, and the second lift pin, respectively, begin tilting the door 40 toward the lift frame 15. In particular, the lift pin 42 rotates within the brake assembly 121 and the second lift pin rotates within the second brake assembly thereby rotating the door 40. In addition, the slot 105 and the slot 108 of the guide arm bracket 97 and the guide arm bracket 98 rotate about the hinge pin 46 and the hinge pin 47 respectively. As the door 40 tilts, the guide arm 210 of the articulating arm assembly 201 and the guide arm 250 of the articulating arm assembly 202 rotate around their respective bearings 214 and 254 such that the guide arms 210 and 250 rotate toward the lift frame 15 until the door 40 reaches a substantially parallel position relative to the lift frame 15.

After the door 40 reaches a substantially parallel position relative to the lift frame 15, the guide arm bracket 97, which initially contacts the hinge pin 46 at the second end 107 of the slot 105, also lowers vertically such that the first end 106 of the slot 105 contacts the hinge pin 46. In addition, the guide arm bracket 98, which initially contacts the hinge pin 47 at the second end 110 of the slot 108, also lowers vertically such that the first end 109 of the slot 108 contacts the hinge pin 47. Once the first end 106 of the slot 105 contacts the hinge pin 46 and the first end 109 of the slot 108 contacts the hinge pin 47, the door 40 ceases traveling vertically downward and the door 40 reaches its closed position, which in the preferred embodiment is substantially parallel in relation to the lift frame 15.

Furthermore, once the door 40 reaches a substantially parallel position to the lift frame 15 and before the door 40 reaches its closed position, the door 40 engages the lock system 300. In particular, as the door 40 moves to its substantially parallel position relative to the lift frame 15, the door 40 locates the pin 318 above the lock notch 324 of the lock bracket 314, and the continued downward movement of the door 40 moves the pin 318 into the lock notch 324, thereby securing the door 40 to the lift frame 15. Likewise, movement of the door 40 to its substantially parallel position relative to the lift frame 15, locates the lock pins 304 above the receiving cavities 354, and the continued downward movement of the door 40, moves the lock pin 304 into the receiving cavities 354, thereby securing the door 40 to the building foundation or the ground.

In addition, as the door 40 is moving from its open to its closed position, the controller 501 monitors the close limit switch 508 to determine when the door 40 has reached its closed position. Once the door 40 reaches its closed position, it contacts the close limit switch 508 resulting in the close limit switch 508 outputting a signal to the controller 501 indicating the door 40 has reached its closed position. Upon receipt of the signal, the controller 501 closes the hydraulic valve 506 thereby preventing hydraulic fluid from exiting the driver 401 and ceasing movement of the door 40.

The invention claimed is:

1. A door system, comprising:

a one-piece tilt-up door;

a lift frame, wherein the lift frame comprises first and second guide columns with a header therebetween;

a brake system disposed within the lift frame and coupled with the door, wherein the brake system comprises a first brake assembly disposed in the first guide column and connected to the door via a lift pin, wherein the first brake assembly is movable between an unlocked position whereby the first brake assembly moves relative to the first guide column and a locked position whereby the first brake assembly engages the first guide column to stop movement of the first brake assembly relative to the first guide column;

an articulating arm system connected to the lift frame and the door; and a drive system connected to the brake system, wherein the drive system moves the brake system within the lift frame such that the brake system and the articulating arm system guide the door between a closed position and an open position, further wherein:

moving the door from the closed position to the open position, comprises:

the drive system raising the brake system within the lift frame such that the brake system moves the door vertically upward, the door rotating relative to the brake system, and the articulating arm system guiding the rotation of the door such that the door rotates away from the lift frame thereby tilting the door away from the lift frame until the drive system ceases raising the brake system within the lift frame, whereby the door resides in the open position, and moving the door from the open position to the closed position, comprises:

the drive system lowering the brake system within the lift frame such that the brake system moves the door vertically downward, the door rotating relative to the brake system, the articulating arm system guiding the rotation of the door such that the door rotates toward the lift frame thereby tilting the door to a substantially parallel position with the lift frame, and the drive system ceasing lowering the brake system within the lift frame, whereby the door resides in the closed position.

2. The door system according to claim 1, wherein the first brake assembly, comprises:

a lifting block including a lift pin receiving slot that receives the lift pin therethrough, the lift pin receiving slot including a first end and a second end and being elongated to allow for movement of the lifting block relative to the lift pin, the lifting block being coupled with the drive system, wherein the coupling of the lifting block with the drive system moves the lifting block relative to the lift pin such that the lift pin engages the first end of the lift pin receiving slot whereby the first brake assembly resides in its unlocked position;

a linear bearing assembly engaged by the lift pin, wherein the lift pin receiving slot allows for movement of the lifting block relative to the linear bearing assembly;

a safety brake connected between the lifting block and the linear bearing assembly, the relative to the first guide column and an extended position whereby the safety brake engages the first guide column to stop movement of the first brake assembly relative to the first guide column, wherein the coupling of the lifting block with the (hive system moves the lifting block relative to the linear bearing assembly such that the safety brake moves to its retracted position;

a biasing member connected between the lifting block and the linear bearing assembly, the biasing member being movable between a first position and a second position, wherein the coupling of the lifting block with the drive system moves the lifting block relative to the linear bearing assembly such that the biasing member moves to its first position, further wherein, upon a decoupling of the lifting block from the drive system, the biasing member moves from its first position to its second position, thereby moving the lifting block relative to the linear bearing assembly and the lift pin such that the lift pin engages the second end of the lift pin receiving slot and the safety brake moves to its extended position whereby the first brake assembly resides in its locked position.

3. The door system according to claim 1, wherein the brake system, her comprises a second brake assembly disposed in the second guide column and connected to the door via a lift pin, wherein the second brake assembly is movable between an unlocked position whereby the second brake assembly moves relative to the second guide column and a locked position whereby the second brake assembly engages the second guide column to stop movement of the second brake assembly relative to the second guide column.

4. The door system according to claim 3, wherein the second brake assembly, comprises:

a lifting block including a lift pin receiving slot that receives the lift pin therethrough, the lift pin receiving slot including a first end and a second end and being elongated to allow for movement of the lifting block relative to the lift pin, the lifting block being coupled with the drive system, wherein the coupling of the lifting block with the drive system moves the lifting block relative to the lift pin such that the lift pin engages the first end of the lift pin receiving slot whereby the second brake assembly resides its unlocked position;

a linear bearing assembly engaged by the lift pin, wherein the lift pin receiving slot allows for movement of the lifting block relative to the linear bearing assembly;

a safety brake connected between the lifting block and the linear bearing assembly, the safety brake being movable between a retracted position whereby the first brake assembly moves relative to the first guide column and an extended position whereby the safety brake engages the first guide column to stop movement of the second brake assembly relative to the second guide column, wherein the coupling of the lifting block with the drive system moves the lifting block relative to the linear bearing assembly such that the safety brake moves to its retracted position;

a biasing member connected between the lifting block and the linear bearing assembly, the biasing member being movable between a first position and a second position, wherein the coupling of the lifting block with the drive system moves the lifting block relative to the linear bearing assembly such that the biasing member moves to its first position, further wherein, upon a decoupling of the lifting block from the drive system, the biasing member moves from its first position to its second position, thereby moving the lifting block relative to the linear bearing assembly and the lift pin such that the lift pin engages the second end of the lift pin receiving slot and the safety brake moves to its extended position whereby the second brake assembly resides in its locked position.

5. The door system according to claim 3, wherein the drive system, comprises:

a driver secured with the header, the driver being movable between a first position that opens the door and a second position that closes the door;

pulley assemblies secured with the header;

a first cable connected with the driver and running from the driver in a first direction, the first cable being engaged with the pulley assemblies such that the pulley assemblies redirect the first cable to a second direction prior to directing the first cable to the first brake assembly, wherein movement of the driver to its first position results in the first cable lifting the first brake assembly thereby opening the door, further wherein movement of the driver to its second position results in the first cable lowering the first brake assembly thereby closing the door, and a second cable connected with the driver and running from the driver in the first direction, the second cable being engaged with the pulley assemblies such that the pulley assemblies direct the second cable to the second brake assembly, wherein movement of the drive to its first position results in the second cable lifting the second brake assembly thereby opening the door, further wherein movement of the driver to its second position results in the second cable lowering the second brake assembly thereby closing the door.

6. The door system according to claim 5, wherein the pulley assemblies comprise a first pulley assembly secured with the header, a second pulley assembly secured with the header at a first end, and a third pulley assembly pulley assembly secured with the header at a second end, further wherein:

the first pulley assembly redirects the s cable from the first direction to the second direction and along the second direction to the second pulley assembly, the first pulley assembly directs the second cable along the first direction and to the third pulley assembly, the second pulley assembly directs the first cable along the first guide column and to the first brake assembly, and the third pulley assembly directs the second cable along the second guide column and to the second brake assembly.

7. The door system according to claim 5, wherein movement of the driver between its first position and its second position simultaneously acts upon the first cable and the second cable to lift and lower the first and second brake assembly thereby opening and closing the door.

8. The door system according to claim 1, further comprising a guide arm bracket secured to the door, the guide arm bracket including a slot having a first end and second end.

9. The door system according to claim 8, wherein the articulating arm system, comprises:

a support arm securable with the lift frame;

a guide arm including a first end and a second end, the guide arm securable at the first end with the support arm such that the guide arm rotates about the first end; and a hinge pin securable with the second end of the guide arm, wherein the hinge pin engages the slot of the guide arm bracket such that the hinge pin allows rotational and vertical movement of the door; further wherein the first end of the slot initially contacts the hinge pin when the door resides in its closed position.

10. The door system according to claim 9, further comprising a lock system, wherein the lock system comprises:

a latch assembly, comprising a lock bracket secured with the header of the lift frame and a latch secured with the door and engageable with the lock bracket, and;

at least one lock pin secured with the door at a lower portion thereof.

11. The door system according to claim 10, wherein, when the door resides in the closed position, the latch engages the lock bracket and the lock pin engages a receiving cavity of a foundation supporting the lift frame to secure the door against wind forces.

12. The door system according to claim 11, wherein moving the door from the closed position to the open position, comprises:

the drive system raising the brake system within the lift frame such that the lift pin moves the door vertically upward;

the guide arm bracket rising vertically until the second end of the slot contacts the hinge pin of the articulating arm system, the latch disengages from the lock bracket, and the lock pin disengages from the receiving cavity;

the lift pin rotating within the brake system and the slot of the guide arm bracket rotating about the hinge pin thereby rotating the door; and the articulating arm system guiding the rotation of the door such that the guide arm rotates away from the lift frame around its first end thereby tilting the door away from the lift frame until the drive system ceases raising the brake system within the lift frame, whereby the door resides in the open position.

13. The door system according to claim 12, wherein moving the door from the open position to the closed position, comprises:

the drive system lowering the brake system within the lift frame such that the lift pin moves the door vertically downward;

the lift pin rotating within the brake system and the slot of the guide arm bracket rotating about the hinge pin thereby rotating the door;

the articulating arm system guiding the rotation of the door such that the guide arm rotates toward the lift frame around its first end thereby tilting the door to a substantially parallel position with the lift frame;

the guide arm bracket lowering vertically until the first end of the slot contacts the hinge pin of the articulating arm system, the latch engages the lock bracket, and the lock pin engages the receiving cavity; and the brake assembly and the lift pin cease traveling vertically downward whereby the door resides in the closed position.

14. The door system according to claim 1, wherein the door comprises a support truss that prevents bending and bowing in the door when the door moves between its closed and open positions.

* * * * *